US008355650B2

(12) United States Patent
Kawanami

(10) Patent No.: US 8,355,650 B2
(45) Date of Patent: Jan. 15, 2013

(54) COLOR ELECTROPHOTOGRAPHIC IMAGE FORMING APPARATUS

(75) Inventor: Takeo Kawanami, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/113,297

(22) Filed: May 23, 2011

(65) Prior Publication Data

US 2011/0217074 A1 Sep. 8, 2011

Related U.S. Application Data

(62) Division of application No. 12/568,169, filed on Sep. 28, 2009, now Pat. No. 8,112,014.

(30) Foreign Application Priority Data

Sep. 29, 2008 (JP) ..... 2008-249591
Sep. 24, 2009 (JP) ..... 2009-218550

(51) Int. Cl.
*G03G 15/00* (2006.01)

(52) U.S. Cl. ..... 399/110; 399/111

(58) Field of Classification Search ..... 399/88, 399/90, 111, 112, 124
See application file for complete search history.

(56) References Cited

U.S. PATENT DOCUMENTS

| | | | | |
|---|---|---|---|---|
| 7,715,754 | B2 | 5/2010 | Sato et al. | |
| 7,761,024 | B2 * | 7/2010 | Imaizumi et al. | 399/90 |
| 2006/0251446 | A1 | 11/2006 | Okabe et al. | |
| 2007/0160380 | A1 | 7/2007 | Imaizumi et al. | |
| 2009/0180797 | A1 | 7/2009 | Sato et al. | |
| 2009/0226205 | A1 | 9/2009 | Sato et al. | |

FOREIGN PATENT DOCUMENTS

JP 2002-162797 A 6/2002

(Continued)

OTHER PUBLICATIONS

Notification of Ground of Rejection dated Nov. 2, 2009, in counterpart Japanese Application No. JP 2009-218550.

(Continued)

*Primary Examiner* — Hoang Ngo
(74) *Attorney, Agent, or Firm* — Fitzpatrick, Cella, Harper & Scinto

(57) ABSTRACT

A color electrophotographic image forming apparatus, wherein a plurality of cartridges is detachably mountable to a main assembly of the apparatus, includes a cartridge supporting member movable between an inside position which is inside the main assembly and an outside position which is outside the main assembly, supporting the cartridges, wherein the cartridges are mounted to and dismounted from the cartridge supporting member placed in the outside position; an opening which is provided in the main assembly and through which the cartridge supporting member is passed when the cartridge supporting member moves between the inside position and the outside position; a receiving member for receiving developed images from photosensitive members provided on the cartridge supporting member in the state that cartridge supporting member is placed in the inside position, the receiving member is rotatable along below the photosensitive members; a transfer member for transferring the developed images transferred on the receiving member onto a recording material at a transfer position; a fixing member for fixing the developed images transferred onto the recording material on the recording material; and a feeding path for feeding the recording material to a removing position by way of the transfer position, the inside of the opening and the fixing member from a stacking portion for stacking the recording material, wherein the cartridge supporting member is movable between the inside position and the outside position intersecting the feeding path.

6 Claims, 16 Drawing Sheets

FOREIGN PATENT DOCUMENTS

| | | | |
|---|---|---|---|
| JP | 2004-184451 | A | 7/2004 |
| JP | 2004-258440 | A | 9/2004 |
| JP | 2006-184554 | A | 7/2006 |
| JP | 2008-55542 | | 3/2008 |
| JP | 2008-152305 | A | 7/2008 |
| JP | 2009-210937 | A | 9/2009 |

OTHER PUBLICATIONS

Notification of Ground of Rejection dated Feb. 3, 2010, in counterpart Japanese Application No. JP 2009-218550.
Notification of Ground of Rejection dated Mar. 16, 2010, in counterpart Japanese Application No. JP 2009-218550.

* cited by examiner

COLOR ELECTROPHOTOGRAPHIC IMAGE FORMING APPARATUS

This application is a divisional of U.S. patent application Ser. No. 12/568,169, filed Sep. 28, 2009.

FIELD OF THE INVENTION AND RELATED ART

The present invention relates to a color electrophotographic image forming apparatus for forming a color image on a recording material in the state that a cartridge is mounted.

Here, with the color electrophotographic image forming apparatus, the color image is formed on the recording material using an electrophotographic image forming process. The examples of the color electrophotographic image forming apparatus include a color electrophotographic copying machine, a color electrophotographic printer (the color laser beam printer, for example, a color LED printer) a color facsimile device and a color word processor. The recording material is a material on which the electrophotographic image forming apparatus forms an image, and includes a sheet of paper and an OHP sheet, for example.

For example, the cartridge is a process cartridge or a developing cartridge, and is dismountably mounted on a main assembly of the electrophotographic image forming apparatus to contribute to an image formation process for forming the image on the recording material. Here, the process cartridge is a cartridge containing, as a unit, an electrophotographic photosensitive drum, and at least one of process means including charging means, developing means, and cleaning means, and is detachably mountable a main assembly of the electrophotographic image forming apparatus. Therefore, examples of the process cartridge include a cartridge which contains, as a unit, an electrophotographic photosensitive drum and developing means, the cartridge being detachably mountable to the main assembly of the electrophotographic image forming apparatus. Examples of the process cartridge include a cartridge containing, as a unit, an electrophotographic photosensitive drum, and a process means which is charging means, developing means, or cleaning means, the cartridge being detachably mountable a main assembly of the electrophotographic image forming apparatus. The process cartridge which integrally contains the electrophotographic photosensitive drum and the developing means integrally is called "integral type". The process cartridge which integrally contains the electrophotographic photosensitive drum and the process means other than the developing means is called "discrete type".

The process cartridge can be detachably mounted to and demounted from the image forming apparatus by a user. For this reason, the maintenance operations for a main assembly can be carried out easily. The process means is actable on the electrophotographic photosensitive drum.

The developing cartridge includes a developing roller, and accommodates a developer (toner) to be used to develop an electrostatic latent image formed on the electrophotographic photosensitive drum by the developing roller, the cartridge being detachably mountable to the main assembly of the image forming apparatus. In the case of the developing cartridge, the electrophotographic photosensitive drum is mounted to the main assembly or the cartridge supporting member as will be described hereinafter. Or the electrophotographic photosensitive drum is provided in the so-called the discrete type process cartridge (The cartridge does not have the developing means in this case). The developing cartridge can also be mounted to and dismounted from the main assembly of the image forming apparatus by the user. For this reason, the maintenance operation for the main assembly can be carried out easily.

In view of this, as the cartridge, the process cartridge of the so-called the integral type or the so-called discrete type is included. As the cartridge, the case in which the process cartridge and the so-called the developing cartridge of the discrete type constitute a pair is included. As the cartridge, it includes the structure in which the electrophotographic photosensitive drum is fixed to the main assembly or the cartridge supporting member as will be described hereinafter, wherein the developing cartridge is detachably mounted to act on the electrophotographic photosensitive drum.

Heretofore, it has been proposed wherein a plurality of process cartridges are detachably supported on a cartridge supporting member which is movable relative to the apparatus main assembly of the color electrophotographic image forming apparatus (US2007/0160380). According to this structure, a plurality of process cartridges can simultaneously be inserted in the main assembly. A plurality of cartridges can simultaneously be taken out of the main assembly.

The conventional printer described above is improved in the mounting and dismounting operativity of the cartridge relative to the main assembly.

However, when the sheet is jammed, the user removes the sheet from a printer rear surface (a feeding path in a main assembly rear side).

SUMMARY OF THE INVENTION

An object of the present invention is to provide a color electrophotographic image forming apparatus, wherein the operativity in the operation for taking out the recording material which is jammed in the feeding path from the main assembly is improved.

Another object of the present invention is to provide a color electrophotographic image forming apparatus, wherein in spite of using the cartridge supporting member, the operativity of the operation for taking out the recording material which is jammed to the feeding path from the main assembly is improved.

A further object of the present invention is to provide a color electrophotographic image forming apparatus, wherein the recording material which is jammed in the feeding path can be taken out outwardly of the main assembly in the side in which the cartridge supporting member is pulled out of the main assembly.

A further object of the present invention is to provide a color electrophotographic image forming apparatus, wherein the recording material which is jammed in the feeding path can be taken out outwardly of the main assembly in the side in which the exchanging operation of the cartridge is carried out.

According to an aspect of the present invention, there is provided a color electrophotographic image forming apparatus for forming an image on a recording material, wherein a plurality of cartridges is detachably mountable to a main assembly of the apparatus, comprising a cartridge supporting member movable between an inside position which is inside said main assembly of the apparatus and an outside position which is outside said main assembly of the apparatus, supporting said cartridges, wherein said cartridges are mounted to and dismounted from said cartridge supporting member placed in the outside position; an opening which is provided in said main assembly of the apparatus and through which said cartridge supporting member is passed when said cartridge supporting member moves between the inside position and the outside position; a receiving member for receiving developed images from electrophotographic photosensitive members provided on said cartridge supporting member in the state that cartridge supporting member is placed in the inside position, said receiving member is rotatable along below electrophotographic photosensitive members; a transfer member for transferring the developed images transferred on said receiving member onto a recording material at a transfer position; a fixing member for fixing the developed images transferred onto the recording material on the recording material; and a feeding path for feeding the recording material to a removing position by way of the transfer position, the inside of said opening and said fixing member from a stacking portion for stacking the recording material, wherein said cartridge supporting member is movable between the inside position and the outside position intersecting said feeding path.

According to the present invention, in taking out the recording material jammed in the feeding path from the main assembly, the operativity can be improved.

According to the present invention, in spite of using the cartridge supporting member, the operativity at the time of the recording material which is jammed in the feeding path being out of the main assembly can be improved.

According to the present invention, the recording material which is jammed in the feeding path can be taken out outwardly of the main assembly in the side in which the cartridge supporting member is pulled out of the main assembly.

According to the present invention, the recording material which is jammed in the feeding path can be taken out outwardly of the main assembly in the side in which the exchanging operation of the cartridge is carried out.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

The preferred embodiments of the present invention will be described in conjunction with the accompanying drawings The dimensions, the materials, the configurations, the relative positions, and so on of the constituent parts which will be described hereinafter may be properly changed by one skilled in the art depending on the structures and the various conditions of a device to which this invention is applied, and the scope of this invention is not limited to specific dimensions, materials, configurations, relative positions and so on of the embodiments which will be described below.

The first embodiment referring to FIGS. 1-15, the color electrophotographic image forming apparatus (image forming apparatus) according to the first embodiment will be described. Here it is a full-color laser beam printer as the image forming apparatus. General arrangements and functions of this laser beam printer will be described.

General Description of Color Electrophotographic Image Forming Apparatus

Figure 1:
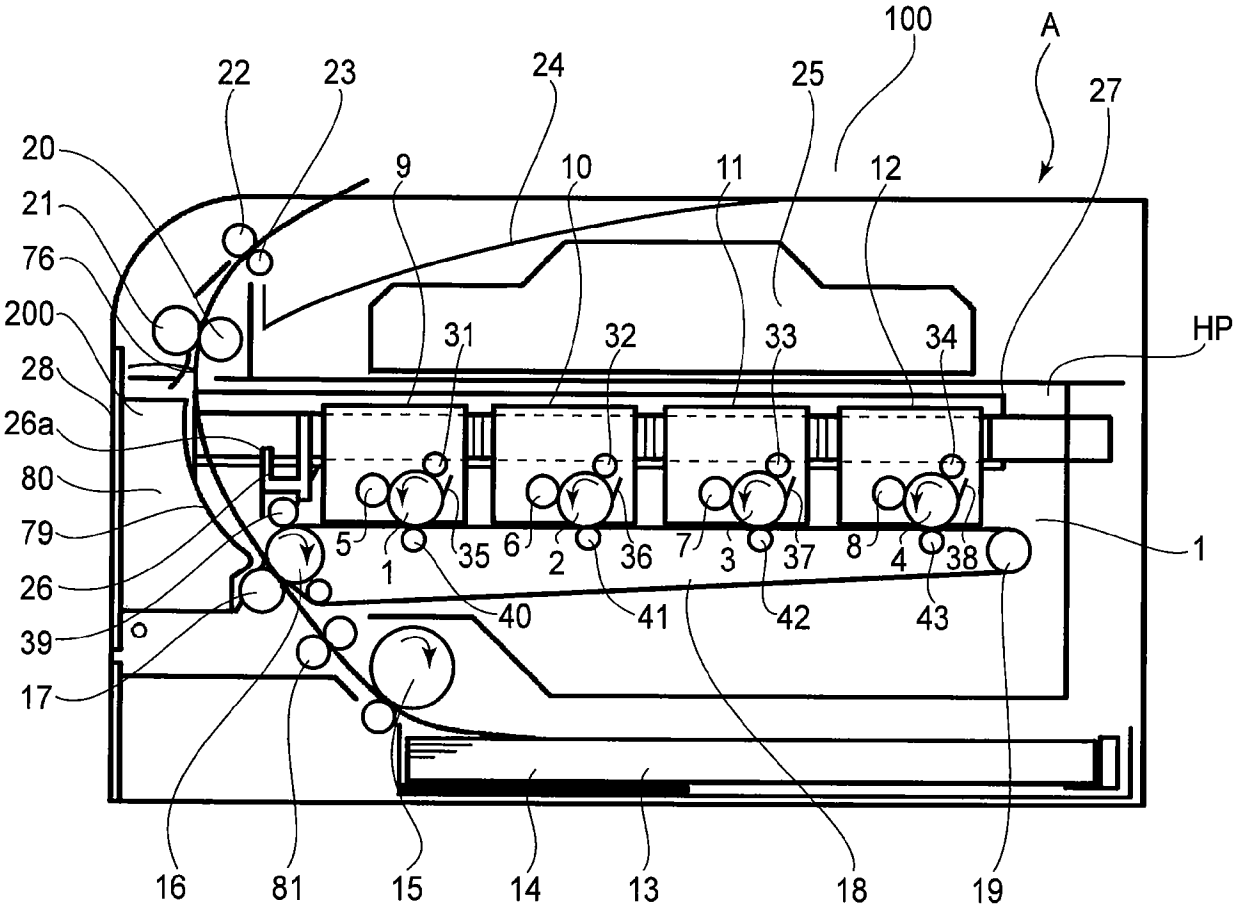
FIG. 1 is a sectional view illustrating an image forming apparatus according to a first embodiment of the present invention.

First, referring to FIG. 1, structures of the image forming apparatus will be described. FIG. 1 is a sectional view illustrating the structures of the image forming apparatus according to the first embodiment. In the following descriptions, a front side of a main assembly A is the side (left-hand side in FIG. 1) which has a door 28 provided openably and closably relative to main assembly A, and a rear side of main assembly A is the opposite side from the door (28) side, and the rear side is provided with a feeding path for a recording material 76. (The side that is shown in FIG. 1.) In the following description, the cartridge is a process cartridge. However, as has been described hereinbefore, the cartridge is not limited to the process cartridge.

The main assembly A of the image forming apparatus 100 is provided with a feeding tray (stacking portion) 13 for accommodating sheets (recording materials) 14, a feeding roller 15, an intermediary transfer belt (transfer member) 18, a fixing roller (fixing member) 20 and a pressing roller (fixing member) 21 which constitute a fixing device, and a laser scanner 25 and so on. A fixing roller 20 and a pressing roller 21 as the fixing members fix a developer image transferred onto the sheet 14 by a transfer roller 17 on the sheet 14. A feeding tray 13 stacks the sheets 14.

The main assembly A is provided with a cartridge tray (cartridge supporting member) 26 supported for movement relative to the main assembly A. A tray 26 supports a plurality of process cartridges (cartridges) 9, 10, 11, 12 dismountably. Each cartridge 9, 10, 11, 12 includes an electrophotographic photosensitive member (photosensitive drum) or 1, 2, 3, 4 of a drum configuration and process means which are actable on the drum integrally. The process means includes a charging roller (charging means) 31, 32, 33, 34, a developing roller (developing means) 5, 6, 7, 8, and a cleaning blade (cleaning means) 35, 36, 37, 38. Therefore, in this embodiment, the cartridge 9 is provided with the drum 1, the charging roller 31, the developing roller 5, and the cleaning blade 35. The charging roller 31 charges the drum 1 electrically. The drum 1 is charged by the charging roller 31 and is exposed to a laser beam, by which an electrostatic latent image is formed on the drum 1. The electrostatic latent image formed on the drum 1 is developed by the developing roller 5 using toner. The toner image is transferred onto an intermediary transfer belt 18 by the first transfer roller (transfer member) 40 (41, 42, 43) as will be described hereinafter. The toner which remains on the drum 1 after the transferring is removed by the cleaning blade 35. The cartridge 9 contains the yellow toner (developer) and develops the electrostatic latent image formed on the drum 1 by the yellow toner. The cartridge 10 contains the magenta toner (developer) and develops the electrostatic latent image formed on the drum 2 by the magenta toner. The cartridge 11 contains the cyan toner (developer) and develops the electrostatic latent image formed on the drum 3 by the cyan toner. The cartridge 12 contains the magenta toner (developer) and develops the electrostatic latent image formed on the drum 4 by the black toner. The cartridges are different in the color of the accommodated toner, but the structures thereof are the same. Each cartridge 9, 10, 11, 12 is dismountably supported by the tray 26, and is set in a predetermined position (mounting portion) in the main assembly A. Here, the main assembly A is the portion of the image forming apparatus 100 other than the cartridges and the tray 26.

Figure 2:
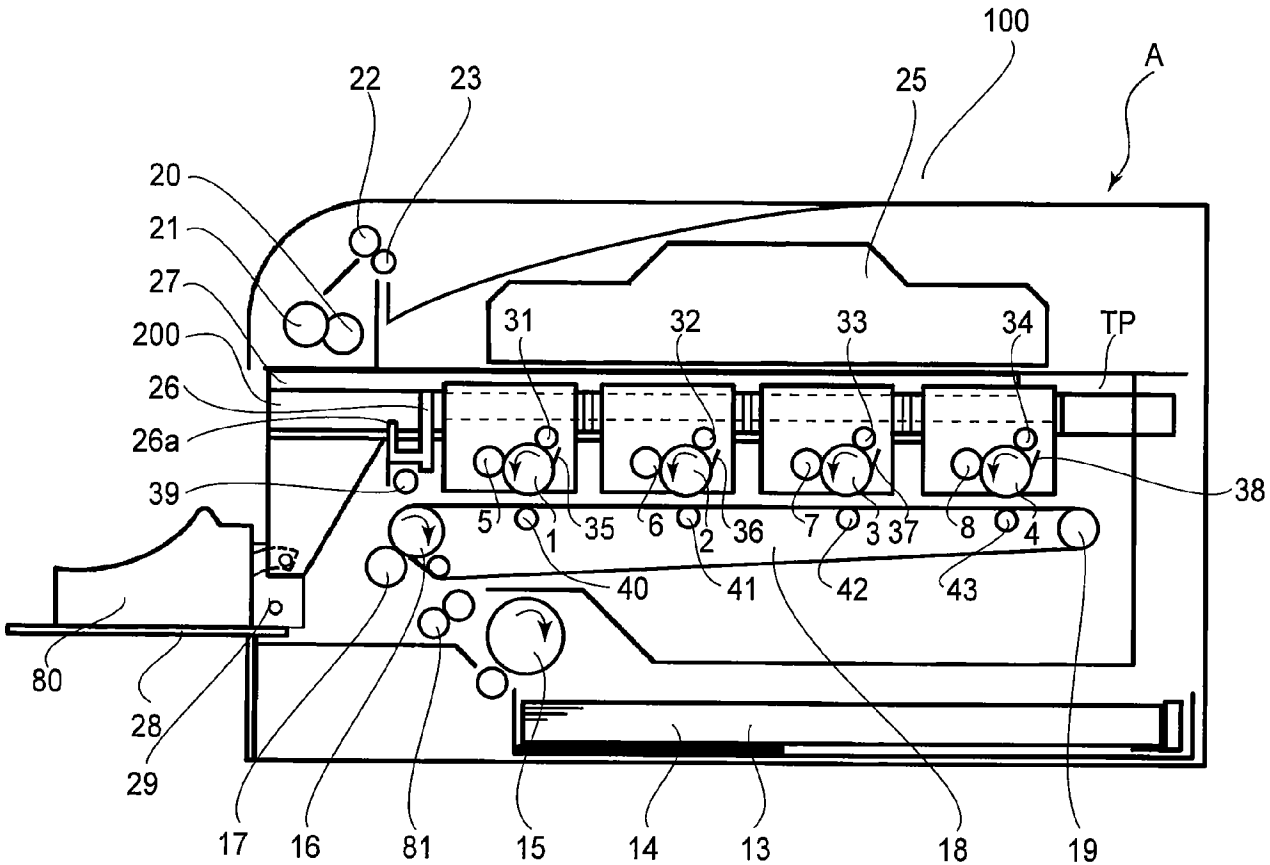
FIG. 2 is a sectional view illustrating the image forming apparatus according to the first embodiment.

The sheet (recording material) 14 accommodated in the feeding tray 13 is fed by the rotatable feeding roller 15 and is fed by a feeding roller 81. The sheet 14 is fed to a nip (transfer portion) between a belt driving roller 16 and a transfer roller (transfer member) 17. The transfer roller 17 transfers the developer image transferred onto a transfer belt 18 onto the sheet 14 at a transfer position 17*a* (FIG. 1, FIG. 2).

An outer surface of the photosensitive drum 1, 2, 3, 4 is exposed in accordance with the image information to the laser beam from the laser scanner 25. By this, the electrostatic latent image is sequentially formed on the drum 1, 2, 3, 4. Subsequently, the electrostatic latent image is developed into the toner image by the developing roller 5, 6, 7, 8.

The toner image formed on the drum 1 (2, 3, and 4) is transferred onto the intermediary transfer belt 18 by the first transfer roller 40 (41, 42, and 43). When forming a color image, the latent images for the yellow color, the magenta color, the cyan color and the black colors are developed on the drums 1, 2, 3, 4, and the developed images are sequentially superimposedly transferred (primary transfer) onto the transfer belt 18. The transfer belt 18 is a rotatable endless belt supported by the tray 26 in a position opposed to the drums 1, 2, 3, 4. The transfer belt 18 is stretched by a belt driving roller 16 and a tension roller 19 and rotates.

The toner image formed on the transfer belt 18 is transferred (secondary transfer) onto the sheet 14 fed to the nip between the belt driving roller 16 and a second transfer roller 17.

After the secondary transfer, the toner remaining on the transfer belt 18 is supplied in the opposite polarity charge by a cleaning roller 39, and is collected into the cartridge 9, 10, 11, 12. The cleaning roller 39 is a belt cleaning member for carrying out the cleaning of the transfer belt 18. The cleaning roller 39 is provided on the tray 26 and is rotated by the transfer belt 18. A bias voltage for applying the charge to the remaining toner is supplied from the main assembly A through the tray 26.

The sheet 14 having the transferred toner image is fed into the nip between a fixing film 20 and pressing roller 21 and is heated and pressed here, so that the toner image is fixed on the sheet 14. Thus the color image is formed on the sheet 14. The heating roller 20 and the pressing roller 21 constitute fixing members (fixing means).

The sheet 14 having the fixed toner image is discharged to a discharging tray (removing position) 24 by a discharging roller 22 and a discharging roller 23. The user takes out the printed sheet 14 from the discharging tray 24.

As has been described hereinbefore, a transfer belt (transfer member) 18 receives the developer image from the photosensitive drum (electrophotographic photosensitive member) 1, 2, 3, 4 provided on the tray 26 in the state where the tray 26 is placed in an inside position I. The transfer belt 18 is rotated along the lower portion of the photosensitive drums 1, 2, 3, 4.

Exchange of Process Cartridge

Figure 3:
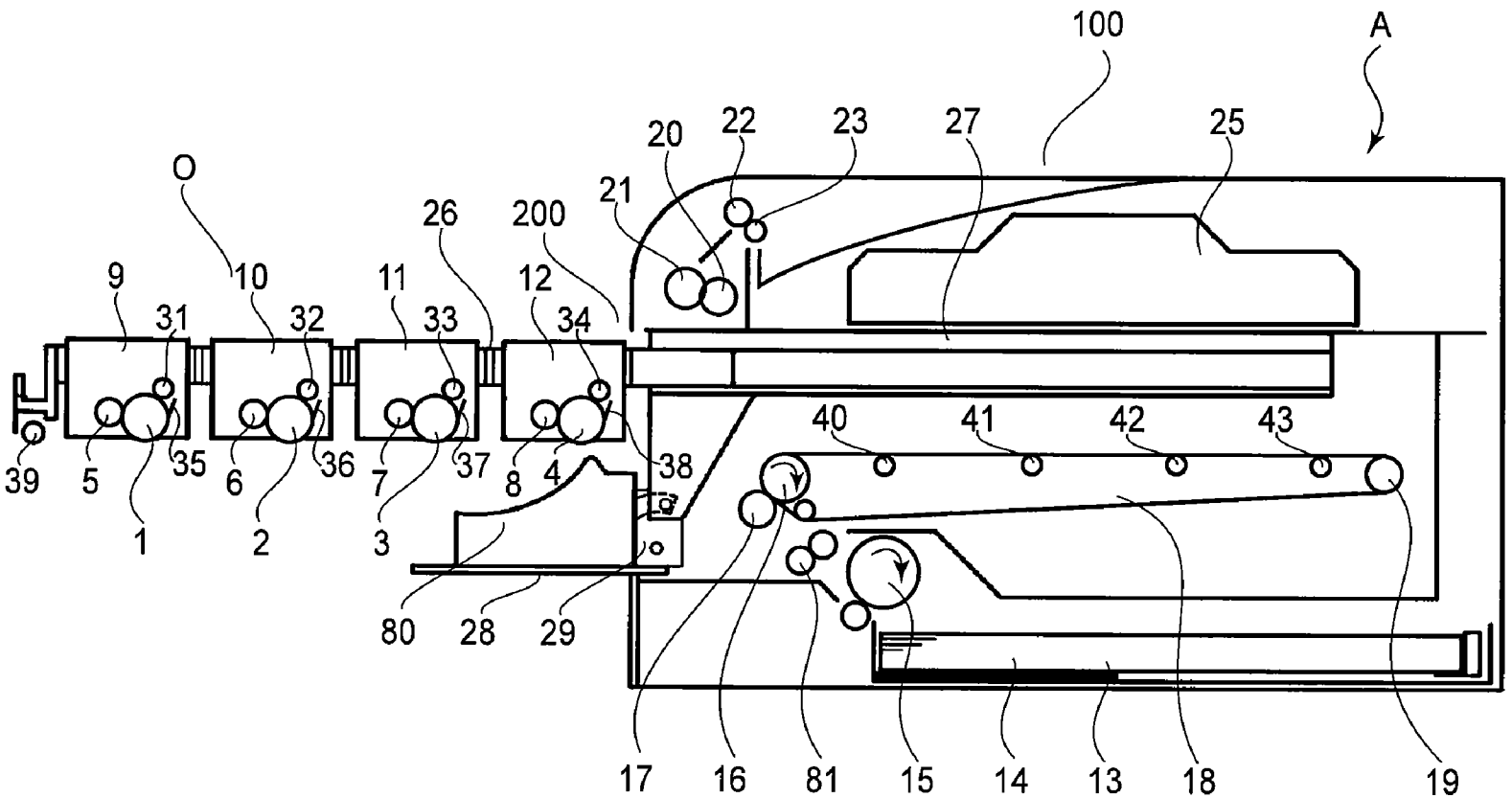
FIG. 3 is a sectional view illustrating the image forming apparatus according to the first embodiment.
Figure 4:
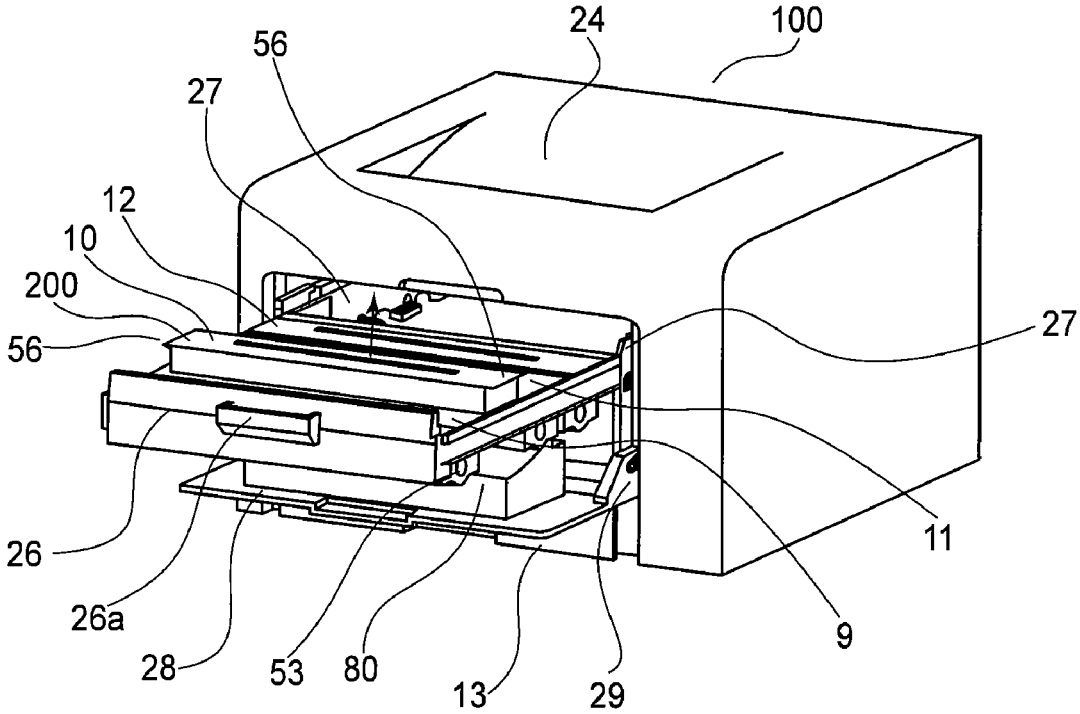
FIG. 4 is a perspective view illustrating the image forming apparatus according to the first embodiment.

FIGS. 2 through 4 are sectional views illustrating the exchanging system of the cartridge. The exchanging system of the cartridge will be described.

The cartridge tray (cartridge supporting member) 26 is supported through a main assembly guide 27 by the main assembly A. The tray 26 is slidable in a transverse direction (FIG. 2) by the main assembly guide 27. The tray 26 supports and mounts the cartridges 9, 10, 11, 12 dismountably.

A door (opening and closing member) 28 is provided rotatably relative to the main assembly A. The door 28 opens and closes an opening 200 provided in the main assembly A in order to carry out an operation such as a jam clearance and a cartridge exchange. The door 28 openably closes the opening 200. The opening 200 is provided in the main assembly A, and when the tray 26 moves between the inside position I and an outside position O, it passes therethrough. In FIG. 2, the door 28 is open. A feeding guide portion (guiding member) 80 constitutes a part of a feeding path 76 for guiding the sheet 14. A guide portion 80 is integral with the door 28 inside of the door 28. The guide portion 80 guides the sheet 14 passed between the driving roller 16 and the transfer roller 17 to guide into between the heating roller 20 and the pressing roller 21. The guide portion 80 has an arch configuration (curved configuration) which projects to the outside of the main assembly A in the state where the door 28 is closed. The guide portion 80 is provided in a downstream side with respect to a drawing direction (FIG. 14) 500 in which the tray 26 moves from the inside position I to the outside position O. The guide portion 80 guides the sheet fed in the feeding path 76 toward the fixing member (20, 21).

The tray 26 is provided with a grip portion (grip member) 26*a*. The user can access the grip portion 26*a* by opening the door 28. The door 28 is provided in the main assembly guide 27 rotatably through a door link 29. The door link 29 pulls out the main assembly guide 27 to the front side in the state where the door 28 is opened. The door link 29 moves the main assembly guide 27 to a retracted position TP (FIG. 2) which is at an upper left position from a home position HP (FIG. 1). The home position HP is an image forming position for contributing to an image formation. In the present embodiment, the image forming position is the position in which the drum 1 (2, 3, 4) of the cartridge contacts the transfer belt 18. A retracted position TP is the position in which the drum 1 (2, 3, 4) of the cartridge is separated from the transfer belt 18. In the case where the cartridge 9 (10, 11, 12) is in the image forming position, the tray 26 may not support the cartridge.

Figure 9:
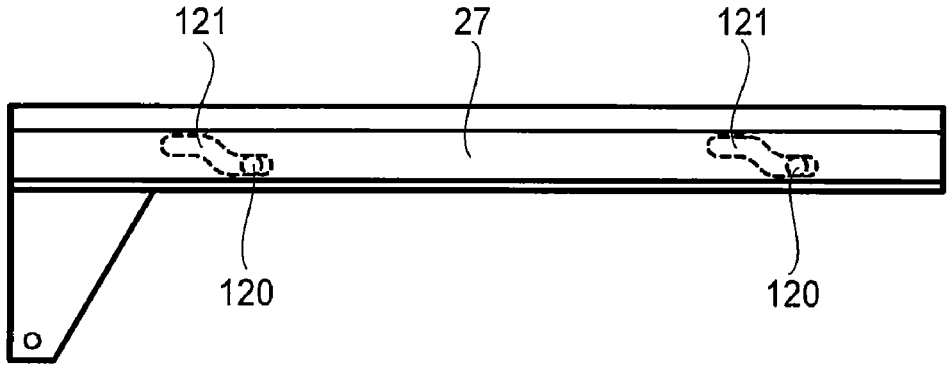
FIG. 9 is a major part enlarged view illustrating the image forming apparatus according to the first embodiment.

Referring to FIG. 9, the specific description will be made. When the user opens the door 28, a guide 27 is pulled out through the door link 29 to a left-hand side. The guide 27 is provided with a boss 120. The main assembly (A) side is provided with a groove 121 for guiding the boss 120. When the guide 27 is pulled out, the boss 120 moves along the groove 121. Then, the guide 27 is raised from a home position HP to a TP position. By a movement of the guide 27, the tray 26 supported by the guide 27 moves upwardly. The drum 1 (2, 3, 4) and the cartridge 9 (10, 11, 12) supported by the tray 26 spaces from the transfer belt 18. By this, the tray 26 becomes retractable from the main assembly A.

As has been described hereinbefore, the tray 26 is moved in the direction parallel to the installation surface (unshown) of the main assembly A. However, it not limited to this example in the present embodiment, but the tray 26 may be moved linearly relative to the installation surface (unshown) of the main assembly A angularly upwardly or angularly downwardly, for example. The tray 26 is moved linearly in the direction perpendicular to the longitudinal direction of the cartridge which it supports. The longitudinal direction of the cartridge is the longitudinal direction of the photosensitive drum 1 or the longitudinal direction of the developing roller 5.

The transfer roller 17 is pressed to the driving roller 16 through the transfer belt 18. The transfer roller 17 is disposed below the cartridge set the image forming position. The fixing means (fixing roller 20 and roller 21) is disposed above a movement range (outward) of the tray 26. By this, the influence of the heat of the fixing means to the cartridge is suppressed. By this, the transfer roller 17 and the fixing means do not prevent the movement of the tray 26.

As has been described hereinbefore, the opening 200 is opened by opening the door 28. By this, the tray 26 can be pulled out of the main assembly A. By the user pulling the grip portion 26*a*, the tray 26 is pulled out.

FIG. 3 shows the state in which the tray 26 has been pulled out of the inside position (mount position) I (the position in FIG. 1) in the main assembly A to the outside position (mounting and dismounting position) O outside the main assembly A (the position shown in FIG. 3). In this state, the upper surfaces of the cartridges 9, 10, 11, 12 are released. Therefore, the user can dismount the cartridge 9 (10, 11, 12) upwardly from the tray 26 (FIG. 4).

An operation for mounting the cartridges 9, 10, 11, 12 to the main assembly A is carried out through the order opposite to the order in the dismounting operation of the cartridges 9, 10, 11, 12. More particularly, in the state that the tray 26 has been pulled out to the outside position (FIG. 3), the cartridges 9, 10, 11, 12 are supported on the tray 26. Thereafter, the user pushes the tray 26 into the main assembly A. And, the user shuts the door 28. By this, the guide 27 is depressed toward the lower left through the door link 29 (FIG. 2). Therefore, the tray 26 is lowered. By this, the cartridges 9, 10, 11, 12 supported by the tray 26 are mounted to the inside position (mount position and portion) in the main assembly. And, the photosensitive drums 1, 2, 3, 4 contact the transfer belt 18.

Figure 5:
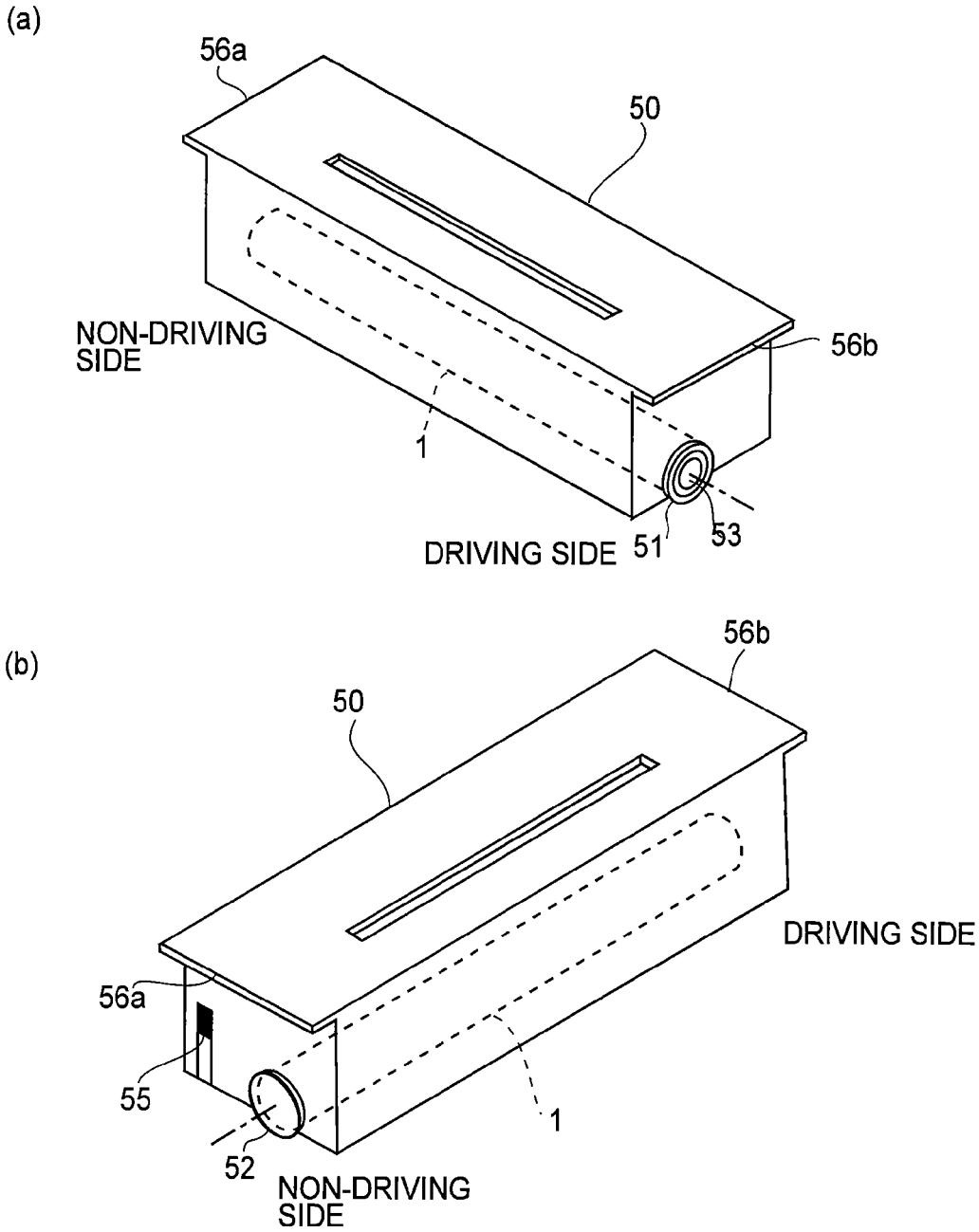
FIG. 5 is a perspective view illustrating a cartridge according to the first embodiment.

FIG. 5 is an outer appearance perspective view of the cartridge 9. Here, (a) is a perspective view, as seen from a driving side, and (b) is a perspective view, as seen from a non-driving side. Here, although the description will be made as to the cartridge 9, the cartridges 10, 11, 12 also have the same structure as the cartridge 9, and are filled with the different color toner.

The cartridge 9 is an assembly of an oblong box shape, and the longitudinal direction thereof is the direction of an axis of the photosensitive drum 1. The drum 1 is supported rotatably between a bearing portion 51 provided on the right side surface of a cartridge frame 50 and a bearing portion 52 provided on a left side surface. The bearing portion 51 is provided with a coupling engaging portion (drum driving input portion) 53. A left side surface portion is provided with a cartridge electrical contact 55. The one longitudinal end and the other longitudinal end of a frame 50 are provided with the visors 56*a* and 56 which are extending and overhung from a top plate portion b. The visors 56*a* and 56 *b* perform the function of protection from a dropping object when the cartridge 9 is inserted into the tray 26. More particularly, the visors 56*a* and 56 *b* are supported by a widthwise end upper surface of the tray 26. By this, the cartridge 9 is supported by the tray 26.

A coupling engaging portion 53 and a drive coupling (unshown) of the main assembly A engage with each other. By this, a rotational force is transmitted from the main assembly A to the drum 1.

Figure 6:
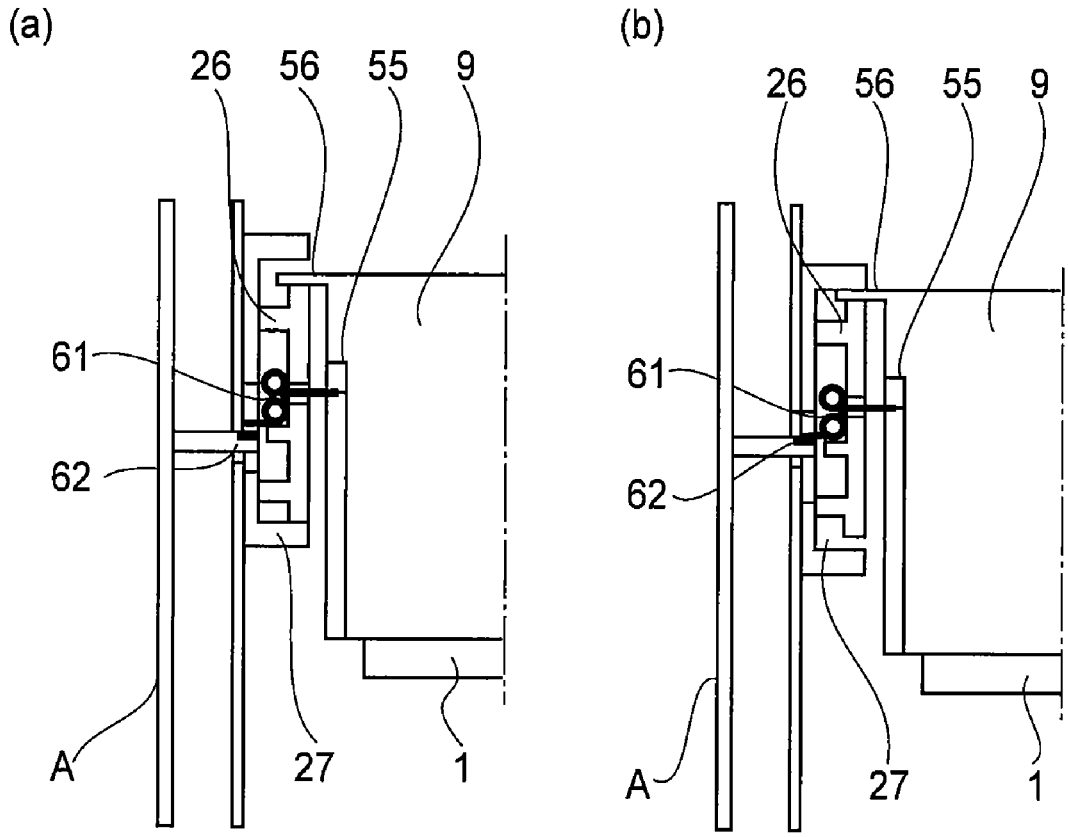
FIG. 6 is a major part sectional view illustrating the image forming apparatus according to the first embodiment.

As shown in FIG. 6, the tray 26 has an intermediate electrical contact 61 electrically connected to an electrical contact 55 of the cartridge 9. When the cartridge 9 is supported by being inserted into the tray 26, they are connected with each other electrically.

As shown in FIG. 6 (*b*) an electrical contact 61 is electrically connected with a main assembly side electrical contact 62 provided in the main assembly A in the state where the tray 26 is depressed down.

As shown in (a) of FIG. 6, on the other hand, in the state where the tray 26 is lifted by the guide 27, the electrical contact 61 and an electrical contact 62 are spaced from each other. Therefore, the electrical contact does not obstruct the sliding movement of the tray 26 along the guide 27.

Locking Mechanism for Cartridge Tray

When the tray 26 is in a predetermined position in the main assembly A, the tray 26 is automatically locked relative to the main assembly, and when the locking thereof is released, the tray 26 pops out of the main assembly. The structure therefor will be described. According to this structure, the operativity in the exchange of the cartridge can be improved.

Figure 11:
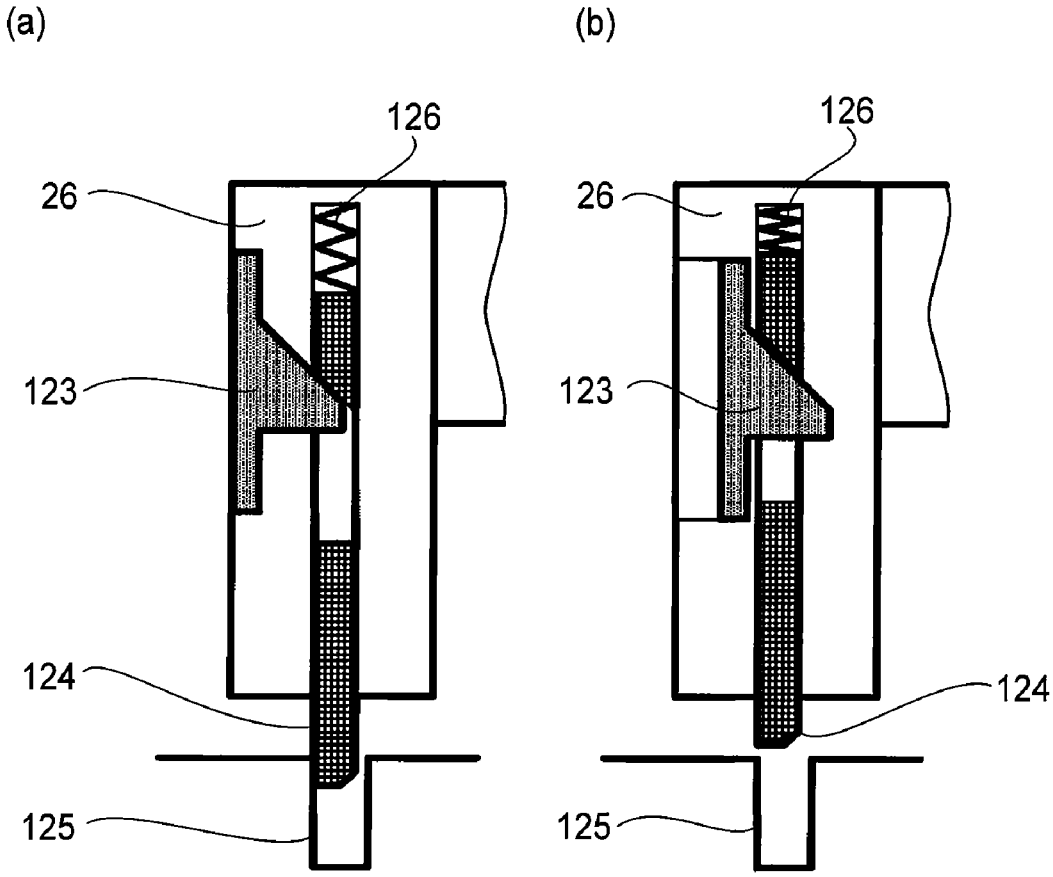
FIG. 11 is a major part enlarged view illustrating the image forming apparatus according to the first embodiment.
Figure 10:
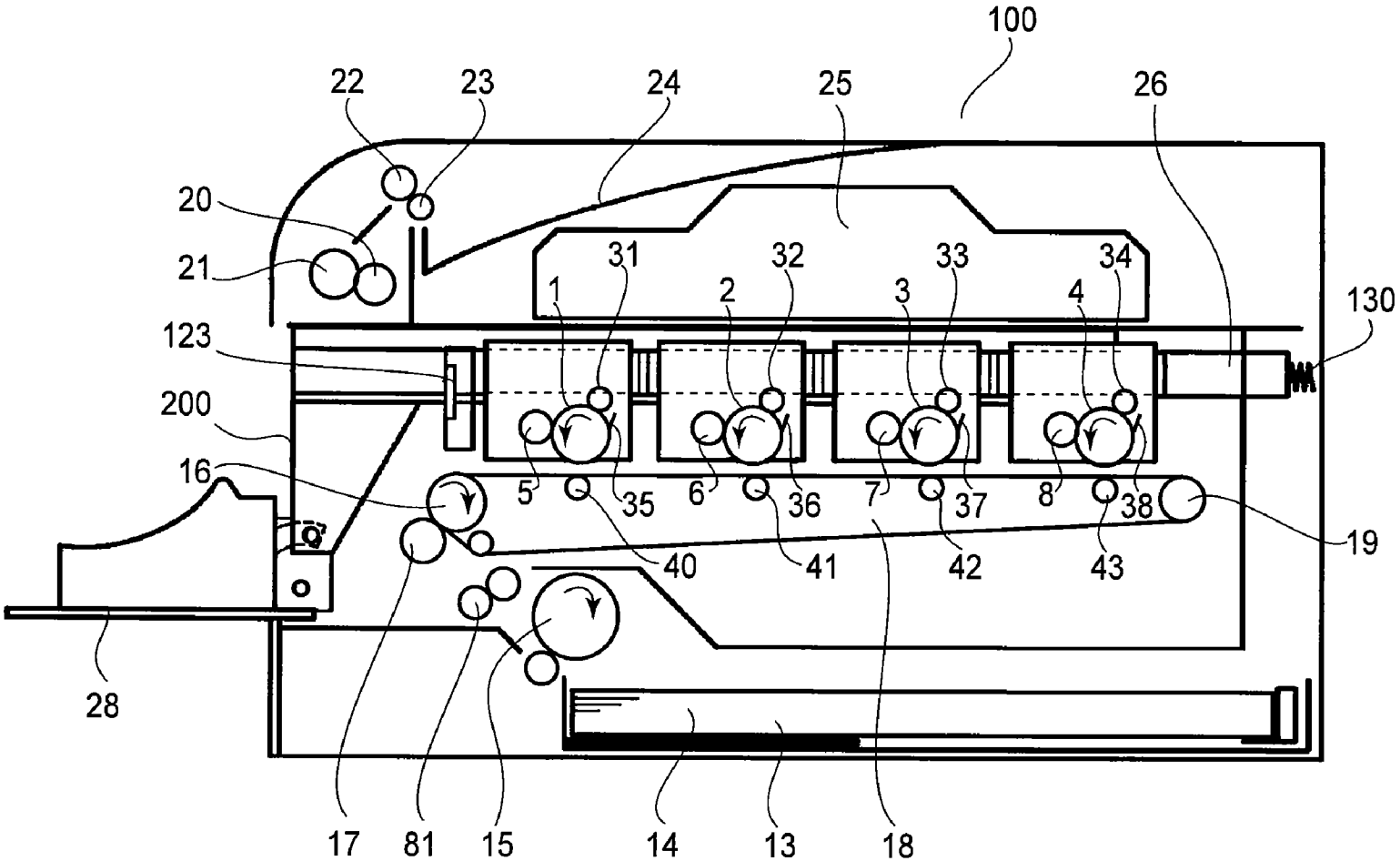
FIG. 10 is a sectional view illustrating the image forming apparatus according to the first embodiment.

Here, referring to FIGS. 10 and 11, the locking mechanism of the tray will be described. As shown in FIG. 10, the tray 26 is urged toward the outside of the main assembly from the inside of the main assembly by an elastic force of an extrusion spring (the member and elastic material) 130. As shown in FIG. 11, the main assembly A is provided with a locking groove 125. The tray 26 is provided with a locking shaft 124 engageable with the locking groove 125. The locking shaft 124 is urged downwardly by the elastic force of a compression spring (urging member and material) 126.

As shown in FIG. 11 (*a*) therefore, by pushing in the tray 26 to the predetermined position, the locking shaft (locking means and portion) 124 urged by the elastic force of the spring 126 engages with the locking groove (locking means and portion-to-be-engaged) 125 automatically. By engaging the locking shaft 124 with the locking groove 125, the tray 26 is locked to the predetermined position in the main assembly A. In other words the locking means is constituted by the locking shaft 124 and the locking groove 125. The ejection of the tray 26 to outside the main assembly A by an urging force (elastic force) of the spring 130 is prevented.

On the other hand, in pulling out the tray the user pushes a button 123 as shown in (b) of FIG. 11. By this, the locking shaft 124 is raised against the force of the spring 126. By this, the engagement of the locking shaft 124 with the locking groove 125 is released. By releasing the engagement of the locking shaft 124 with the locking groove 125, the tray 26 is pushed out of the main assembly A by the elastic force of the spring 130. Accordingly, since the drawing force for the tray 26 can be reduced, the exchange of the cartridge is easy. As has been described hereinbefore, the spring 126 for urging the tray 26 from the inside of the main assembly A the outwardly of the main assembly A and the locking means (locking shaft 124 and locking groove 125) for locking the tray 26 pushed into the inside position I against the elastic force (urging force) of the spring 126 in the main assembly A are provided.

By releasing the lock of the locking means, the tray 26 is pushed out toward the outside of the main assembly by the elastic force (urging force) of the spring 126.

Sheet Supplying Method

Figure 7:
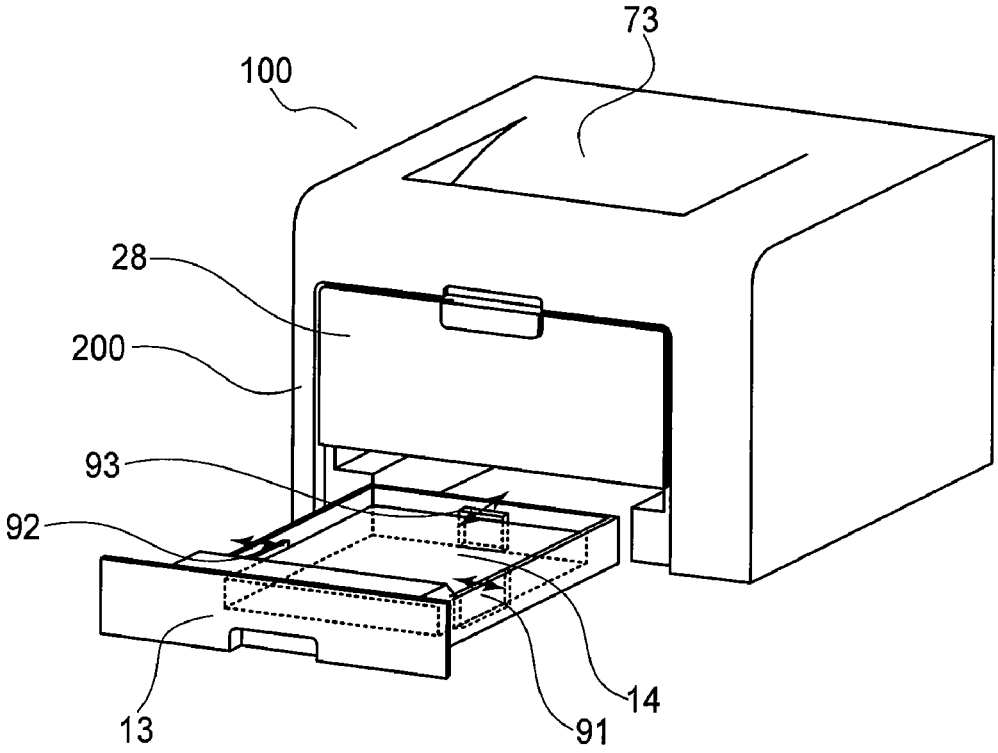
FIG. 7 is a perspective view illustrating the image forming apparatus according to the first embodiment.

FIG. 7 shows a supplying method of the sheet to the inside of the main assembly A. The feeding tray (stacking member) 13 stacks the sheet 14, and is retractable from the main assembly A and can be accommodated in the main assembly A. The feeding tray 13 is retractable frontwardly of the main assembly A. Thus the feeding tray 13 is movable in the direction the same as the movement direction of the tray 26.

By pulling out the feeding tray (stacking portion) 13 to the outside the main assembly A the user can accommodate the sheets 14 in the feeding tray 13. The feeding tray 13 is provided with regulation members 91, 92, 93 for regulating the position of the sheets 14. The regulation members 91, 92, 93 are movable in the left-right direction and the front-rear direction. The regulation members 91, 92, 93 are fixed correspondingly to a size of the sheets 14. By this, the sheet can be set to the predetermined position in the tray 13.

By inserting the feeding tray 13 into the main assembly, the sheets 14 can be set to the predetermined position in the main assembly. The sheets 14 in the feeding tray 13 are fed by the feeding roller 15, and are fed to the image forming station.

Remaining Sheet Removing Method in Main Assembly

Figure 8:
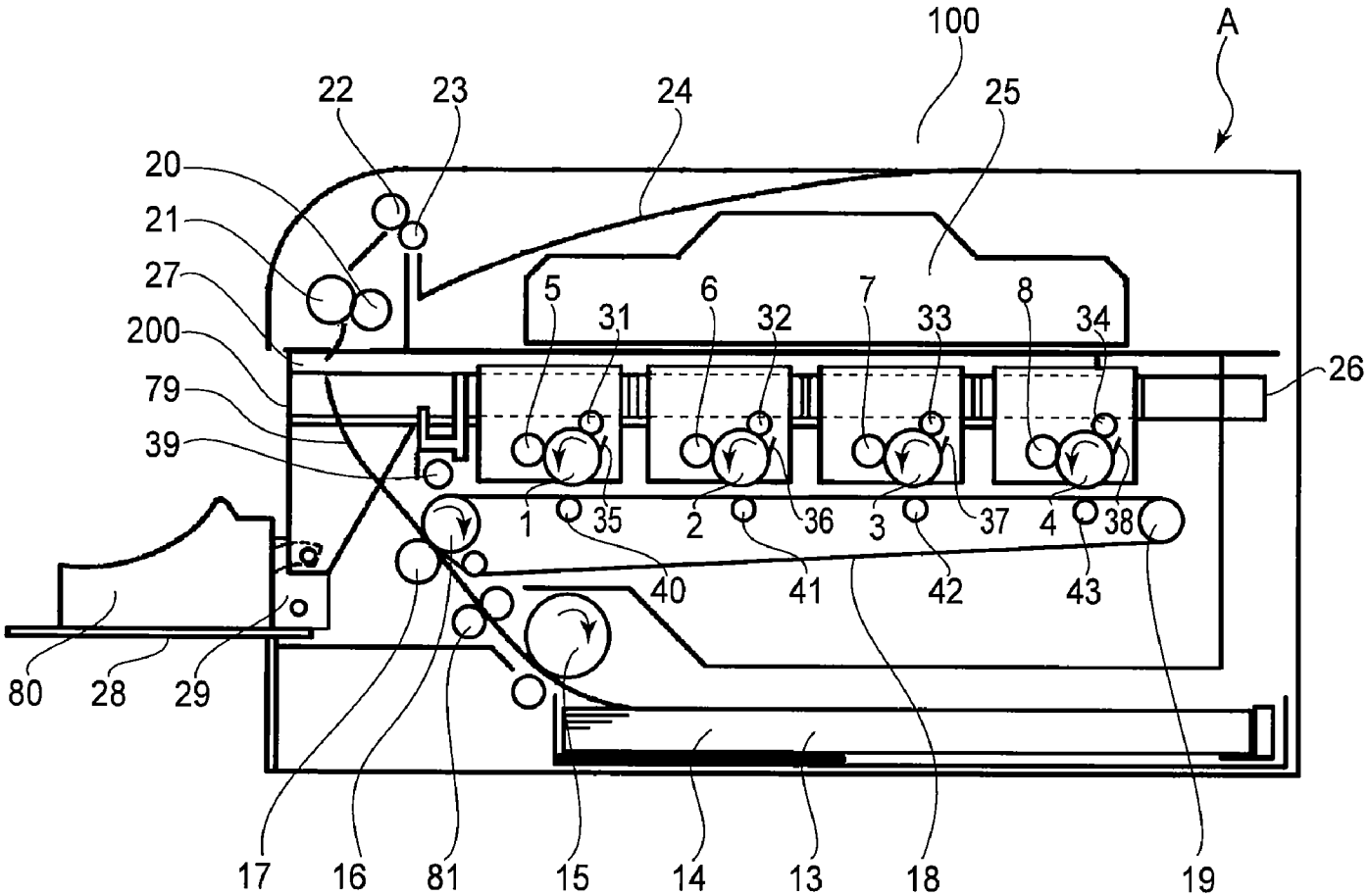
FIG. 8 is a sectional view illustrating the image forming apparatus according to the first embodiment.

FIG. 8 illustrates a method (jam clearance method) for removing the sheet which remains in the main assembly A. The tray 26 is supported by the main assembly A, and is movable between the inside position (mount position) I (FIG. 1) in the position in the main assembly for mounting the cartridge 9 to the main assembly A and the outside position (mounting and dismounting position) O (FIG. 3) in the position outside the main assembly for carrying out the mounting and demounting or exchange of the cartridge relative to the tray 26. As shown in FIG. 8, the tray 26 is mounted to the inside position I inside the feeding path 76 in the main assembly A. The tray 26 is supported by main assembly A (guide 27) so as to move to the outside position O from the inside position I across the feeding path 76. The feeding path 76 feeds the sheet 14 from the feeding tray 13 to discharging tray (removing position) 24 through the transfer position 17*a*, the inside of the opening 200, and the nip between the fixing roller 20 and the pressing roller 21 (fixing member). The tray 26 is movable between the inside position I and the outside position O across the feeding path 76.

With such structures, the user outwardly opens the door 28. By this, the door 28 outwardly exposes the guide portion 80 in the upper portion (FIG. 2, FIG. 3, and FIG. 10). By this, the feeding guide portion 80 to the fixing device (fixing roller 20 and roller 21) from the transfer portion (the nip between the belt driving roller 16 and transfer roller 17) opens. In other words the guide portion 80 is exposed. For this reason, the feeding path 76 in the main assembly is opened. Thus the feeding path 76 is exposed. Therefore, the user can access a sheet 99 (remaining paper 99) which is jammed in the main assembly A. Therefore, the user can take out the sheet 99 from the exposed feeding path 76. The jam clearance completes by taking out the sheet 99. The feeding roller 81 is provided with a one-way-clutch. By this, the feeding roller 81 can be freely rotated in a feeding direction of the sheet 14. The transfer roller 17 is supported so that it presses against the belt driving roller 16. However, the transfer roller 17 is operated interrelatedly with the opening operation of the door 28, so that the pressing is released. The door 28 supports the transfer roller 17, and by opening the door 28, the transfer roller 17 may space from the transfer belt 18. As has been described in the foregoing, the remaining paper 99 in the main assembly can be easily removed from the opening 200.

According to the device 100 of the present embodiment, by drawing the tray 26 through the opening 200, the cartridge can be exchanged. The sheet 14 discharged to the discharging tray 24 can be removed in the front side of the main assembly. Furthermore, the supplement of the sheets 14 to the feeding tray 13 can also be carried out in the front side of the main assembly A.

In this manner, the user can carry out the exchange of the cartridges 9, 10, 11, 12, the supplement of the sheets to the tray 13, the removal of the discharged sheet 14, and the removal of the remaining paper 99 which is jammed in the main assembly A in the same side (main-assembly front-side) of the main assembly A. The main-assembly front-side is provided with the opening 200. Accordingly, the above described operations, the movement of the device 100, the setting at the position spaced from the wall, the operation in the rear surface of the device and so on are unnecessary. Accordingly, the operativity in the operation can be improved.

Second Embodiment

Figure 12:
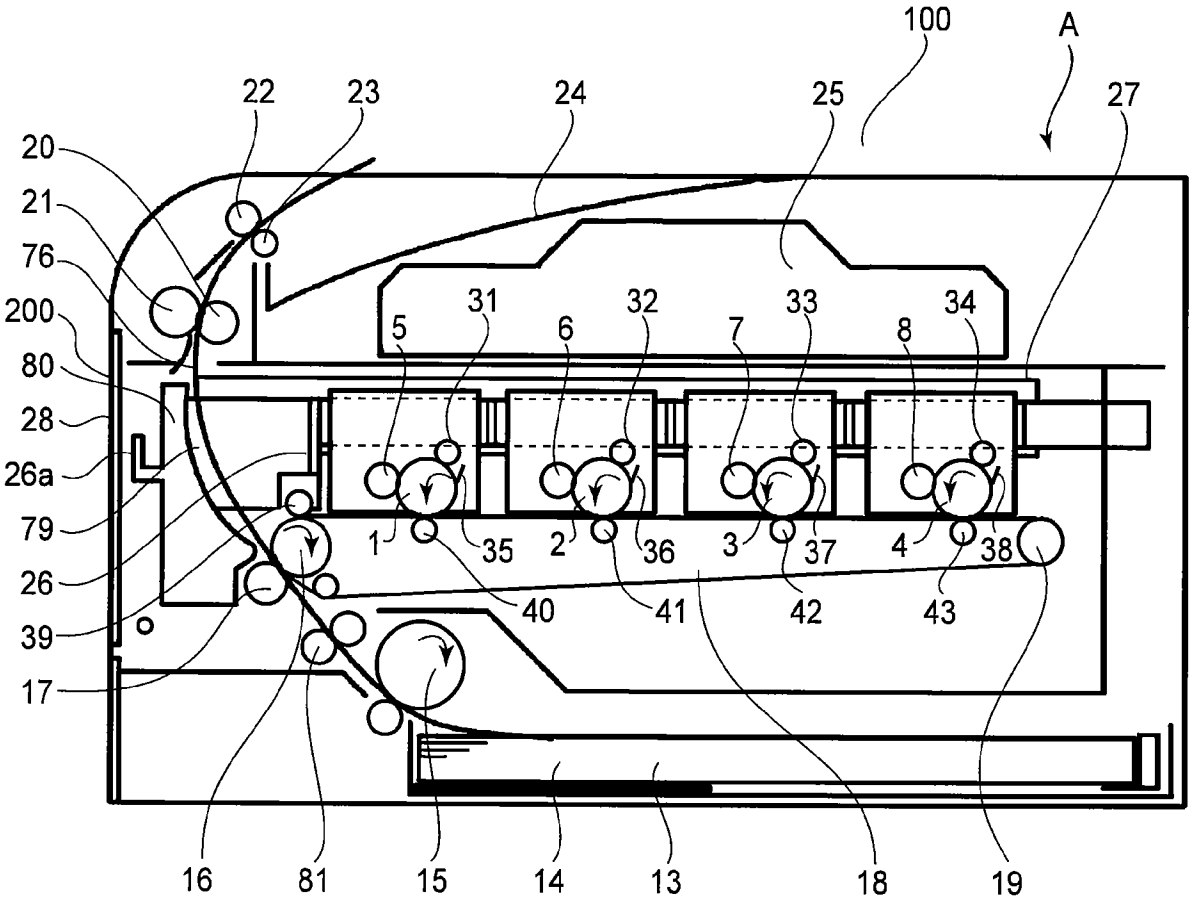
FIG. 12 is a sectional view illustrating the image forming apparatus according to a second embodiment.
Figure 13:
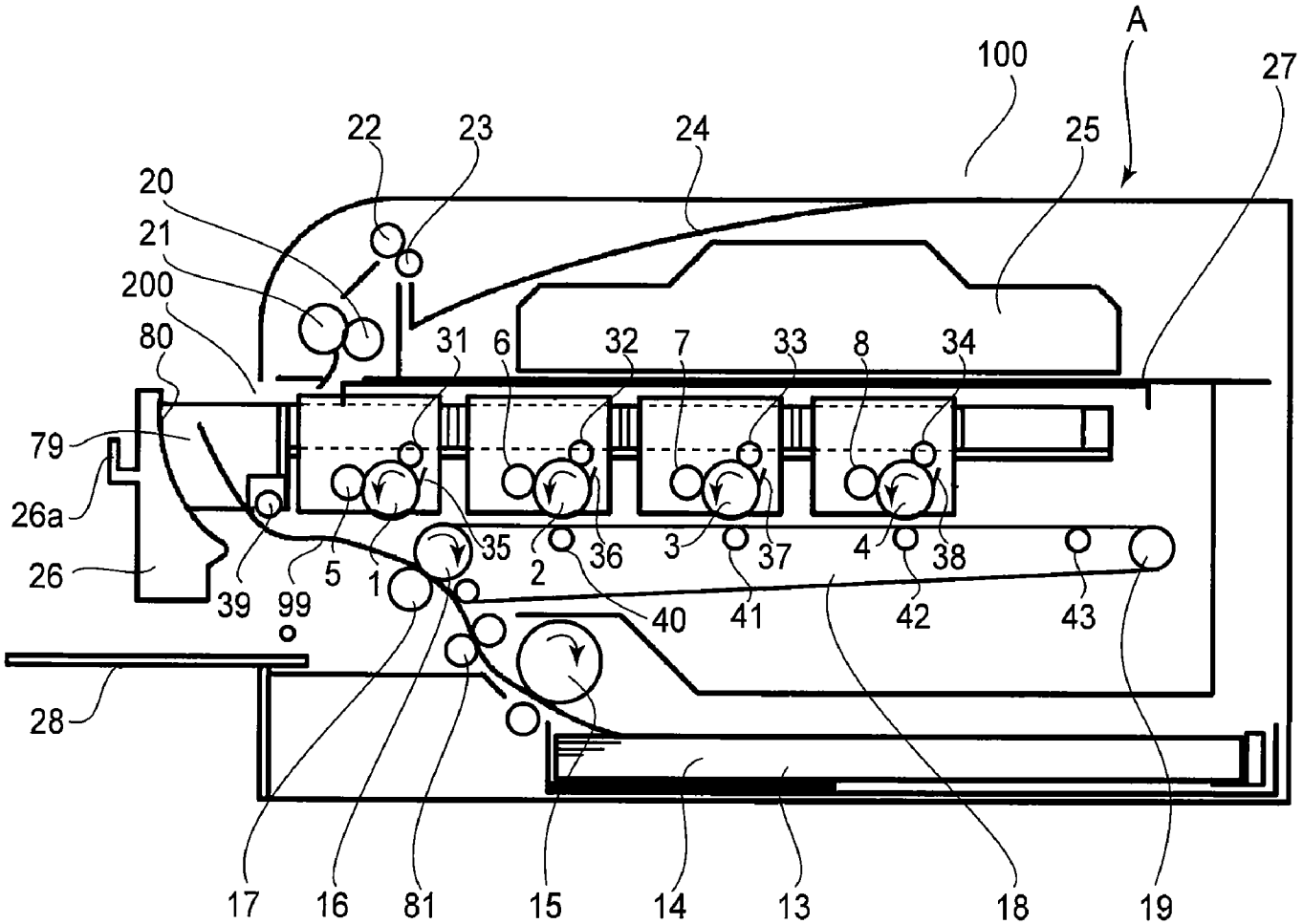
FIG. 13 is a sectional view illustrating the image forming apparatus according to the second embodiment.

Referring to FIGS. 12 and 13, an image forming apparatus according to a second embodiment will be described. FIGS. 12 and 13 are the sectional views illustrating the image forming apparatus according to the second embodiment. Here, a general arrangement of the image forming apparatus is substantially the same as that of the structure in the embodiment described above, the like reference numerals as in the foregoing embodiment are assigned to the elements having the corresponding functions Hereinafter, the portion different from the foregoing embodiment will be described.

As shown in FIGS. 12 and 13, the tray 26 is provided with the feeding guide portion (guiding member) 80 which constitutes a part of the feeding path 76 integrally. In other words the tray 26 is provided with a feeding path 79 which is a part of feeding path 76 integral therein. The feeding guide portion 80 is provided in the downstream side, with respect to the drawing direction, of the tray 26. The sheet 14 which receives the image by a transfer portion 71 is passed along the feeding path 79 provided in the tray 26, and is fed to the fixing device (fixing film 20 and roller 21).

The tray 26 is positioned to the transfer belt 18. The tray 26 is provided with the feeding guide portion 80, and therefore, the guide portion 80 can also be positioned with high precision relative to the transfer belt 18. Accordingly, the feeding property of the sheet 14 can be stabilized.

The method for removing the remaining paper 99 which remains in the feeding path 79 of the tray 26 will be described. Similarly to the embodiment described above, the user opens the door 28. By this, a door link (unshown) and guide 27 moves in interrelation with the door 28. By this, the tray 26 is lifted to the drawable position. Thereafter, the tray 26 is pulled out to the position shown in FIG. 13. By this, the remaining paper 99 in the main assembly can be pulled out outwardly of the main assembly. Therefore, the removal of remaining paper 99 is possible. The structure for nipping the sheet which remains in the feeding path 79 of the tray 26 positively is provided. The jammed sheet may be positively drawn outwardly of the main assembly.

The user can access the tray 26 by opening the door 28. The grip portion 26*a* is provided in the outside of the feeding path 79 main assembly A, and therefore, the accessing is easy.

Third Embodiment

Referring to (a) and (b) of FIG. 14, the image forming apparatus according to the third embodiment will be described. Here, (a) is a sectional view illustrating the image forming apparatus according to the third embodiment. And, (b) is a front view thereof. The like reference numerals as in the foregoing embodiments are assigned to the elements having the corresponding functions, and hereinafter, the portion different from the embodiments described above will be described.

Figure 14:
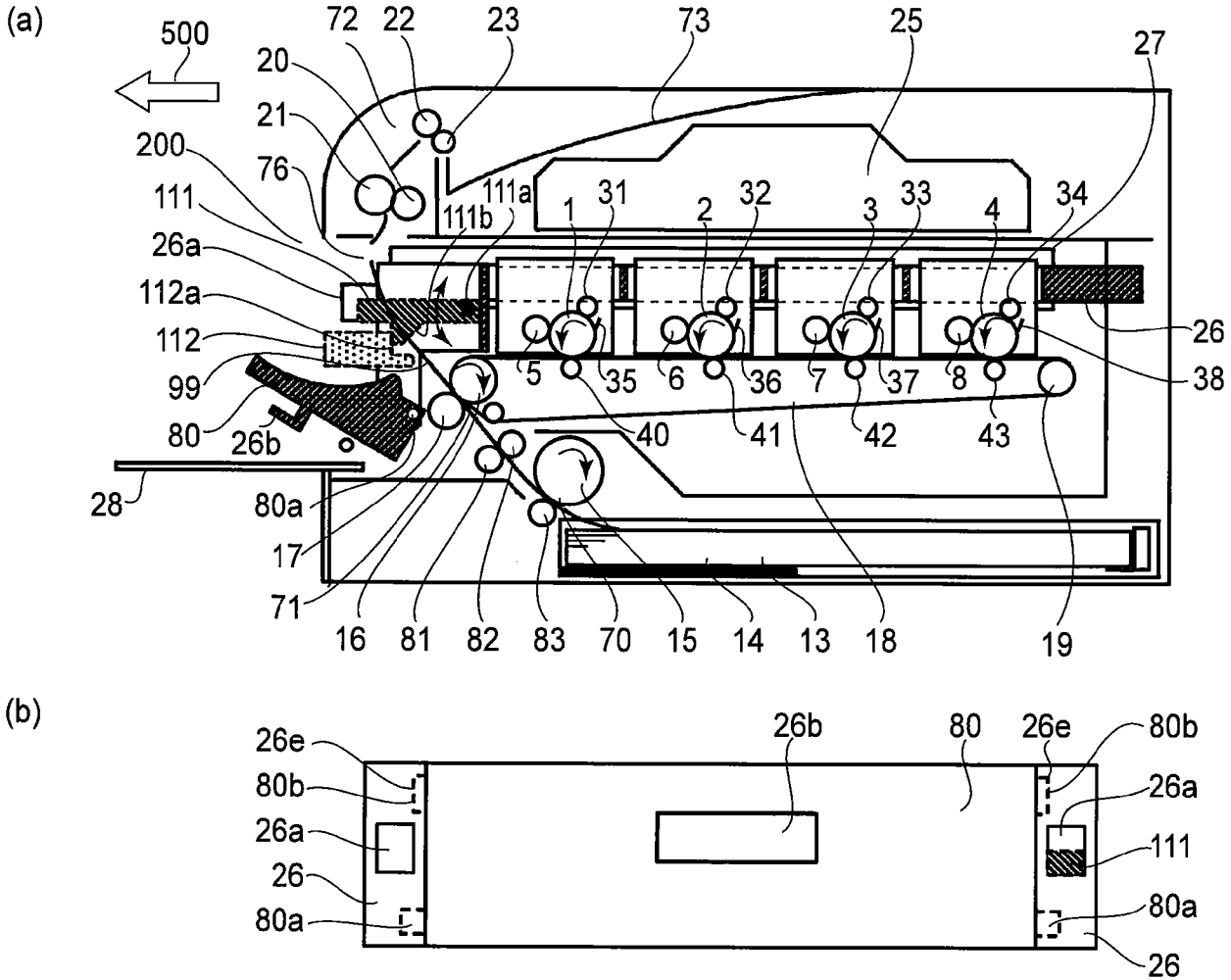
FIG. 14 is a sectional view (a) illustrating the image forming apparatus according to a third embodiment, and is a front view (b) thereof.

As shown in (a) of FIG. 14, the guide portion 80 integral with the tray 26 is openable and closable relative to the tray 26 so that the feeding path 79 is released. Furthermore, the tray 26 is provided with the grip portion (grip member and supporting member side grip portion) 26*a*, and in addition the feeding guide portion 80 is provided with the grip portion (grip member and guide portion side grip portion) 26*b*. The grip portion 26*a* is provided on lateral sides of the tray 26.

With such a structure, the user opens the door 28. Thereafter, the user grips the grip portion (supporting member side grip portion) 26*a*, and pulls out the tray 26 to the outside position O. By this, the cartridges 9, 10, 11, 12 can be exchanged.

The user opens the door 28, and the grip portion (guiding member side grip portion) 26*b* is pulled to open the feeding guide portion 80. By this, the remaining paper 99 in the feeding path 79 of the tray 26 can be removed.

Since the feeding guide portion 80 is rotated, the opening portion is large. For this reason, the removing operation of remaining paper 99 is easy.

In FIG. 14, designated by 111 is a tray lock which is provided in the tray 26. A lock (supporting member side engaging portion) 111 is provided at the one end portion with respect to the direction perpendicular to a movement direction of tray 26, and is rotatable about a shaft 111*a*, provided in the upstream side with respect to the drawing direction (the of the arrow in FIG. 14). When the user grips the grip portion 26*a*, the lock 111 is provided in the position of being together. The lock 111 is urged counter-clockwise by the elastic force of a spring (unshown) and is stopped by contacting a stopper (unshown). The lock 111 can contact with a main assembly lock 112 in this stop position. The lock (main assembly side engaging portion) 112 is fixed to the main assembly A. In pushing in the tray 26 from the outside position O to the inside position I an inclined surface 111*b* of the lock 111 abuts to the lock 112. The inclined surface 111*b* is inclined downwardly toward the downstream side from an upstream side in a drawing direction 500 of the tray 26. The lock 111 is rotated in a clockwise direction against the elastic force of the spring to pass the lock 112. When the lock 111 passes the lock 112, the lock 111 is rotated counter-clockwise by the elastic force of the spring to contact an end 112*a* of the lock 112. Or, when the user grips the grip portion 26*a*, in pushing the tray 26 from the outside position O to the inside position I, the lock 111 is gripped together. By this, the lock 111 is rotated upwardly against the elastic force of the spring, clockwisely. Therefore, the tray 26 is pushed into the main assembly without the lock 111 abutting the lock 112. When the user lifts the hand from the lock 111, the lock 111 is placed in the position engaged with the lock 112. By this, the tray 26 is restricted in the movement to the drawing direction. When the user pulls out the tray 26, the user grips the grip portion 26*a* similarly, and at this time the lock 111 is also gripped. By this, the lock 111 is rotated clockwise against the elastic force of the spring. The lock 111 is retracted upwardly to the position of not contacting with the lock 112. By this, the tray 26 can be pulled out, without being restricted by the lock 112.

Referring to (b) of FIG. 14, a guide portion (guiding member) 80 will be described. The guide portion, 80 is provided on the tray 26 in a downstream end portion with respect to the drawing direction 500, of the tray 26. The guide portion 80 covers the feeding path 76 over the width (the direction perpendicular to the drawing direction 500) of the tray 26. The one end and the other end of the tray 26 which is not covered by the guide portion, 80 with respect to the widthwise direction of the tray 26, is provided with the grip portions 26*a*. When the user pulls out the tray 26, the user grips the grip portion 26*a* to pull out the tray 26 from the main assembly A. When the user takes out the jammed sheet 99 from the feeding path 76, the user pulls the grip portion 26*b* to open the guide portion 80. The guide portion 80 is outwardly rotated about a shaft 80*a*. The shaft 80*a* is provided on the tray 26 at the lower portion in the one longitudinal end and the other longitudinal end of the guide portion 80. The one longitudinal end and the other longitudinal end are provided with the engaged portion 80*b* in the upper part of the guide portion 80. The engaged portion 80*b* is dismountably engaged with an engaging portion 26*e* provided in the tray 26. For example, the engaged portion 80*b* is an elastic claw and the engaging portion 26*e* is a recess. When the user pulls the grip portion 26*b*, the elastic claw separates from the recess, and the guide portion 80 can be opened. For this reason, the jammed sheet 99 in the feeding path 76 can be taken out. When the user closes the guide portion 80, the user grips the grip portion 26*b* and pushes in the guide portion 80, by which the elastic claw elastically engages with the recess. By this, the guide portion 80 can maintain the closed state. In opening the guide portion 80 the tray 26 is regulated in the movement in the drawing direction by the locks 111, 112. Therefore, the guide portion 80 can be opened smoothly. The guide portion (guiding member) 80 is rotatable relative to the tray 26 so that the feeding path 76 is opened. The guide portion 80 is provided with a grip portion (supporting member side grip portion) 26*a* used by the user in the case of the movement of the tray 26 at the one and the other longitudinal ends. The guide portion 80 is provided with a grip portion (guiding member side grip portion) 26*b* used by the user in the case of the opening and closing of the guide portion 80. The main assembly A is provided with the lock (main assembly side engaging portion) 112, and the tray 26 is provided with the lock (supporting member side engaging portion) 111. In the state where the tray 26 is placed in the inside position I, by the lock 111 contacting the lock 112, the tray 26 is prevented from moving from the inside position I to the outside position O. When the user grips the grip portion 26*a*, the lock 111 is also gripped, and the lock 111 separates from the lock 112 against the elastic force. By this, the tray 26 can move from the inside position I to the outside position O.

Fourth Embodiment

Figure 15:
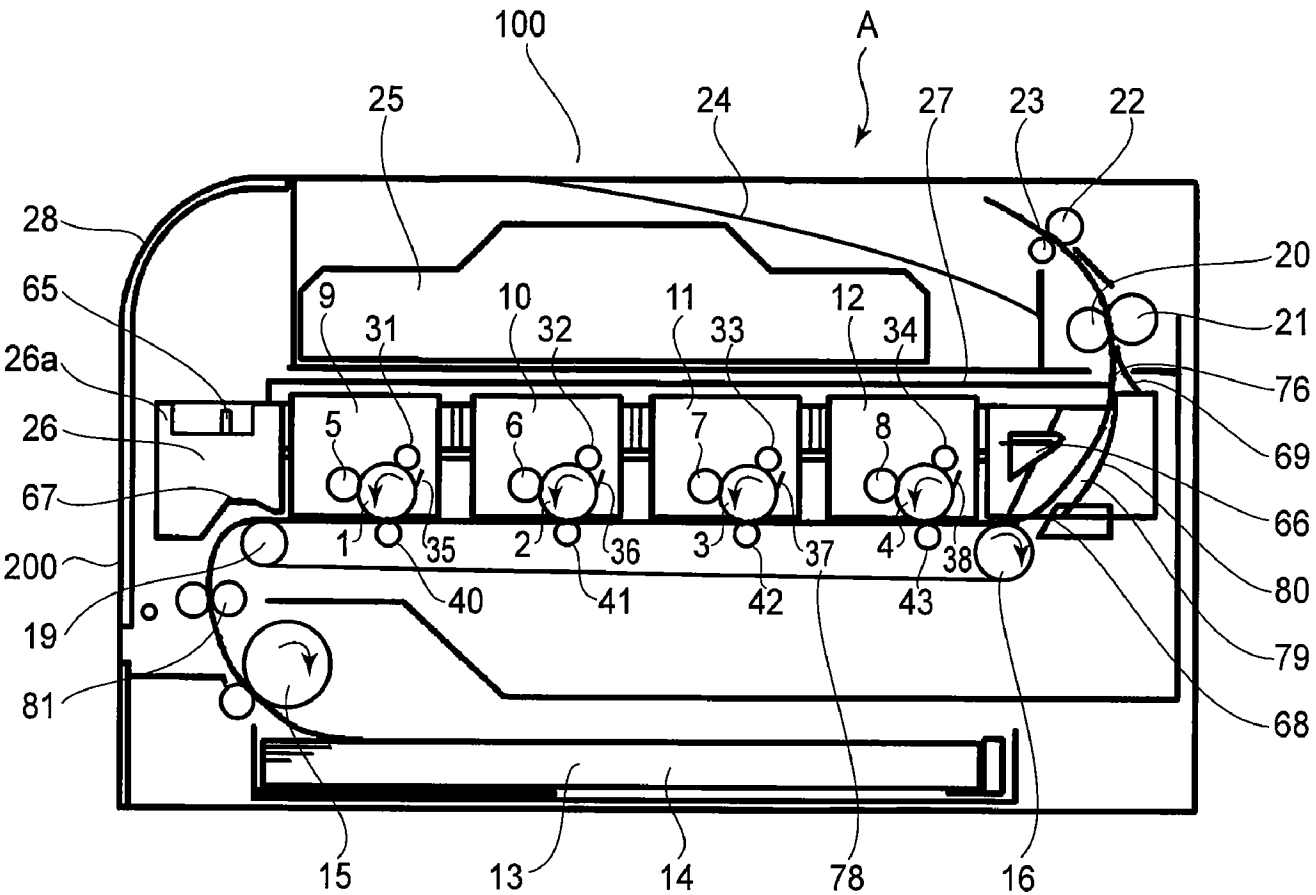
FIG. 15 is a sectional view illustrating the image forming apparatus according to a fourth embodiment.
Figure 16:
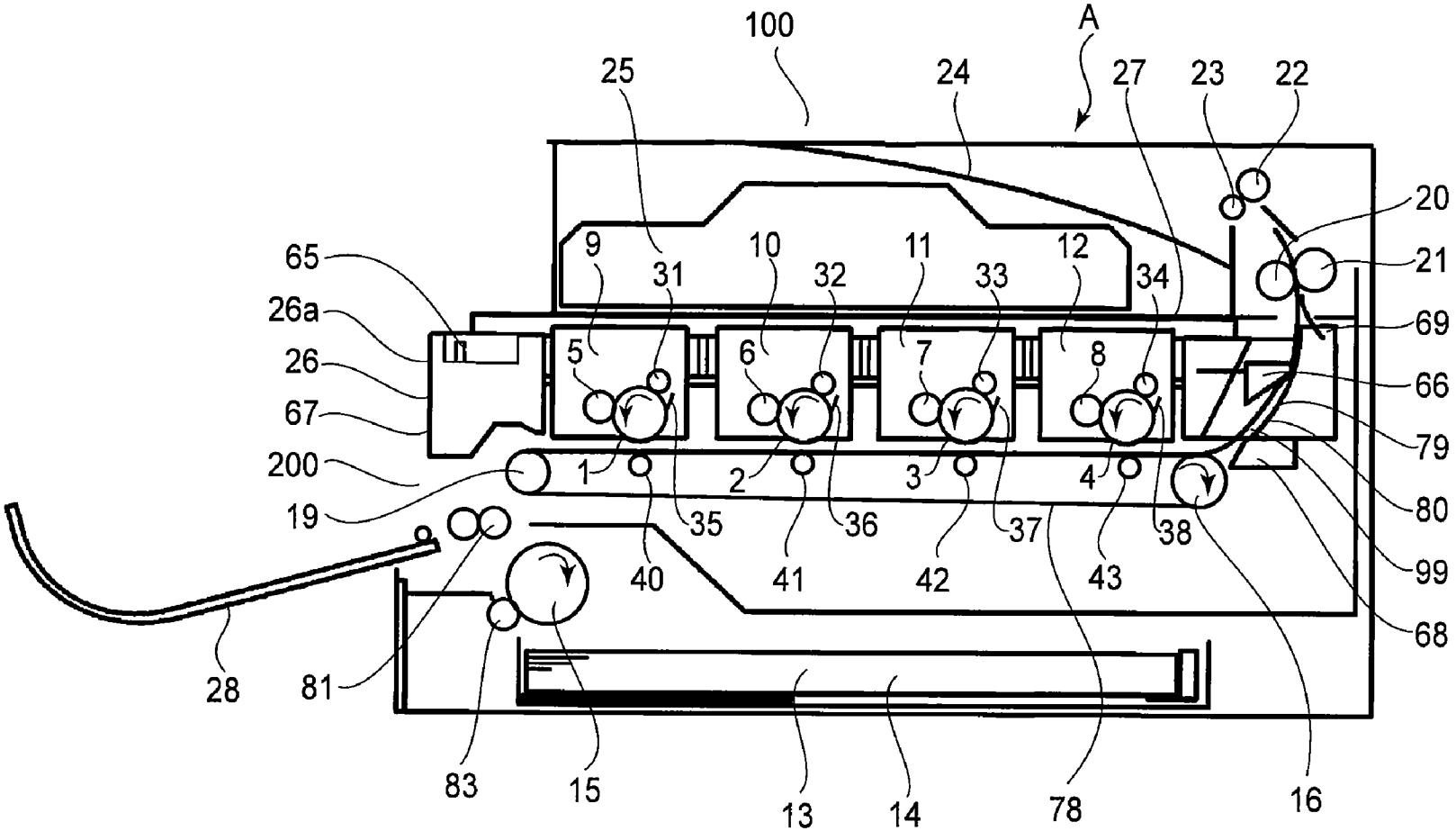
FIG. 16 is a sectional view illustrating the image forming apparatus according to the fourth embodiment.
Figure 17:
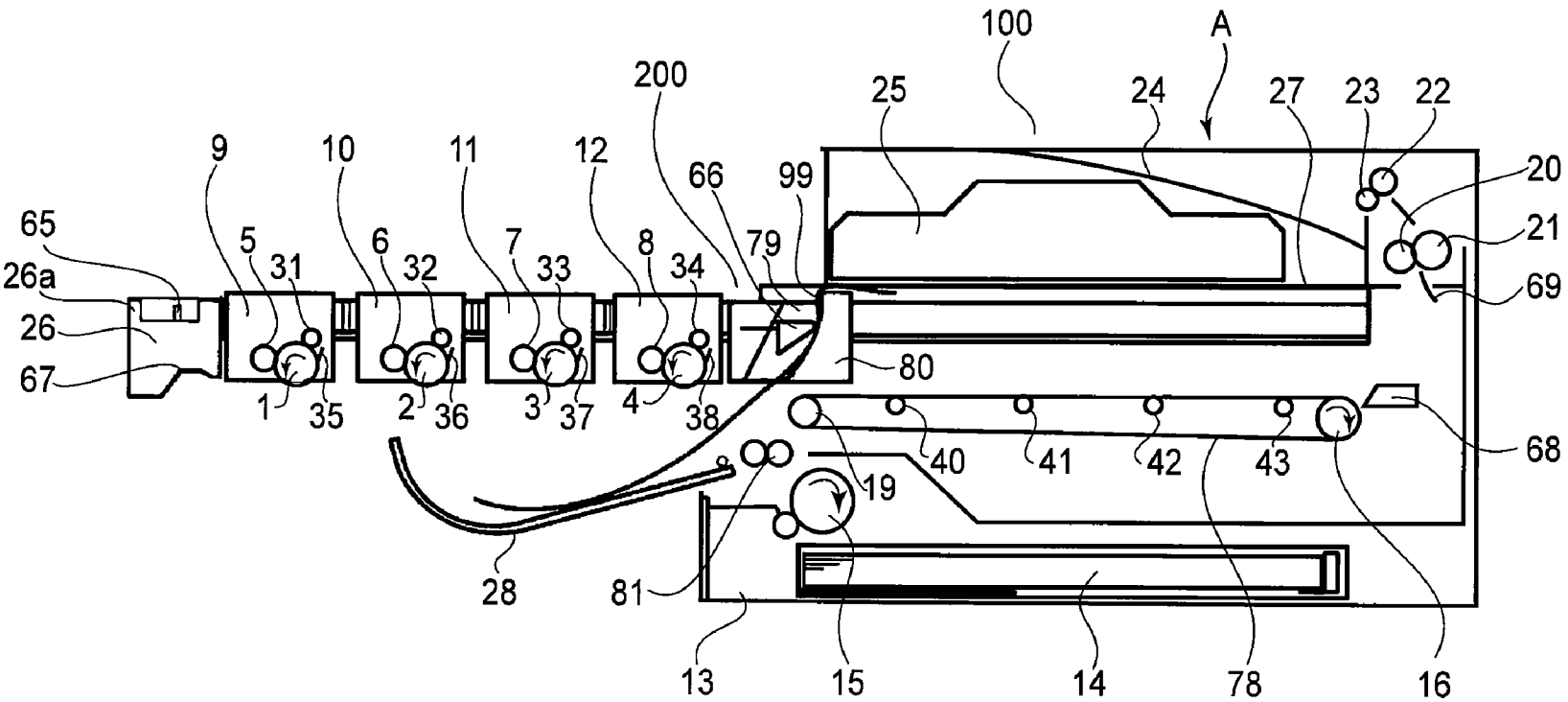
FIG. 17 is a sectional view illustrating the image forming apparatus according to the fourth embodiment.

Referring to FIGS. 15-17, an image forming apparatus according to a fourth embodiment will be described. FIGS. 15-17 are sectional views illustrating the image forming apparatus according to the fourth embodiment.

In the embodiment described above, the color toner images are sequentially overlaid onto the intermediary transfer belt (intermediary transfer member) 18 as the endless belt. And, the toner images carried on the transfer belt 18 are transferred all together onto the sheet 14. In the present embodiment, an electrostatic feeding belt (recording material carrying member) is used as the endless belt, and the color toner images are sequentially transferred superimposedly onto the sheet carried on the electrostatic feeding belt.

The like reference numerals as in the foregoing embodiments are assigned to the elements having the corresponding functions.

Summary of the image forming apparatus: The sheet 14 accommodated in the feeding tray 13 is fed by the feeding roller 15 and fed by the feeding roller 81 to reach an electrostatic feeding belt 78 along a pre-transfer guide 67 provided on the tray 26. A belt 78 feeds the sheet 14 in the state that the sheet 14 is electrostatically attracted on the belt 78. The sheet 14 fed to the transportation belt 78 is electrostatically attracted on the transportation belt 78 and is fed by rotational travelling travel of the transportation belt 78. The transportation belt 78 is an endless belt rotationally travelling through the positions opposed to the photosensitive drums 1, 2, 3, 4 supported by the tray 26. The belt 78 is supported and stretched by the belt driving roller 16 and the tension roller 19.

The color toner images formed on the drums 1, 2, 3, 4 are sequentially transferred superimposedly onto the sheet 14 in the state of attracting on the transportation belt 78. By this, a color image is formed on the sheet 14. The transportation belt 78 feeds the sheet 14 in the state that the sheet 14 is electrostatically attracted. The toner image is transferred onto the sheet 14 by the transfer rollers (transfer members) 40, 41, 42, 43. More particularly the yellow toner image formed on the drum 1 is transferred onto the sheet 14 by a transfer roller 40. The magenta toner image formed on the drum 2 is transferred onto the sheet 14 by a transfer roller 41. The cyan toner image formed on the drum 3 is transferred onto the sheet 14 by a transfer roller 42. The black toner image formed on the drum 4 is transferred onto the sheet 14 by a transfer roller 43. The color toner images are superimposed on the sheet 14. Thus the color image is formed on the sheet 14. As has been described hereinbefore, the transfer rollers (transfer members) 40, 41, 42, 43 transfer the developer images onto the sheet 14 from the drums (electrophotographic photosensitive members) 1, 2, 3, 4 provided on the tray 26 in the state where the tray 26 is placed in the inside position I. For this reason, each transfer roller (transfer member) 40, 41, 42, 43 is provided correspondingly to each drum (FIG. 15, FIG. 16). More particularly, the transfer rollers 40, 41, 42, 43 transfer the developer images formed on the drums 1, 2, 3, 4 onto the sheet 14 at the respective transfer positions.

The sheet 14 which has passed the belt driving roller 16 which supports the transportation belt 78 is separated from the transportation belt 78 by the curvature thereof. The separated sheet 14 is fed to the nip between the fixing roller 20 and the pressing roller 21 along the guide 68 after a transferring, the feeding guide portion 80 as will be described hereinafter, and a pre-fixing guide 69. It is heated and pressed in the nip to fix the toner image on the sheet 14.

The sheet 14 having the fixed toner image is discharged to a discharging tray 73 by the discharging roller 22 and the discharging roller 23.

The tray 26 of the present embodiment is mounted to an inside position (mount position) which is inside of the feeding path 76 for guiding the sheet 14 in the main assembly. The tray 26 is supported by main assembly A (guide 27) so that it moves to the outside position from the inside position I across the feeding path 76.

Furthermore, the tray 26 is provided with the feeding guide portion (guiding member) 80 which constitutes a part of feeding path 76 integrally. The feeding guide portion 80 is provided in the upstream side with respect to the drawing direction of the tray 26. Furthermore, the feeding guide portion 80 is provided with a nipping member (nipping means) 66 for nipping the sheet 14 in the feeding path 79 in the feeding guide portion 80. The nipping member 66 is operated by a lever 65 provided at the grip portion 26*a* of the tray 26. Therefore, in the present embodiment, in pulling out the tray 26 it can take out toward the opening in the state that the jammed sheet 99 is nipped by the nipping member 66. Accordingly, the sheet 99 can be taken out assuredly. As has been described hereinbefore, the nipping member 66 is provided in the upstream side with respect to the drawing direction of the tray 26 to the outside position O from the inside position I. The nipping member 66 nips the jammed sheet 99 between the drum 1 and the transfer roller 40 between the drum 2 and the transfer roller 41, between the drum 3 and the transfer roller 42, between the drum 4 and the transfer roller 43, or between the fixing roller 20 and the pressing roller 21. In the present embodiment when the tray 26 moves in the direction (drawing direction) crossing with the feeding path 76, the jammed sheet 99 is drawn toward an opening 200 (FIG. 15-FIG. 17) in the state that the jammed sheet 99 is nipped by the nipping member 66. According to this structure, the jammed sheet in the rear side of the main assembly can be taken out of the opening (200) side.

Here, the post-transfer guide 68 and the pre-fixing guide 69 are fixed to the main assembly A. However, each of the feeding guide portion 80 of the tray 26 and the after-transferring guide 68 and the pre-fixing guide 69 provided by the main assembly A has a comb-like configuration. Therefore, these members do not disturb a drawing operation of the tray 26.

The supplying method of the sheet to the main assembly A is the same as that of the embodiment described above, and therefore, the description is omitted, for simplicity.

Remaining Sheet Removing Method in the Main Assembly:

The method for removing the sheet which remains in the main assembly will be described.

When the remaining paper 99 in the main assembly stops in the state of popping out of the nip between the discharging roller 22 and the discharging roller 23, by gripping and pulling, it can be removed. When abnormalities are detected by discharge sensor (unshown) and so on, the fixing roller 20 and the pressing roller 21 releases the nip automatically. Therefore, the user can pull out remaining paper 99 easily.

The description will be made as to the case in which the remaining paper 99 in the main assembly stops by the feeding guide portion 80 of the tray 26. By opening the door 28, the door link (unshown) and the guide 27 interrelatedly move to lift the tray 26 to the retractable position. By this, the cartridges 9, 10, 11, 12 are also raised. Therefore, the drums 1, 2, 3, 4 space from the transportation belt 78. When the abnormalities are detected, the nip between the fixing roller 20 and the pressing roller 21 is eased automatically. Therefore, remaining paper 99 is not restrained by any member. The user pulls the lever 65 of the grip portion 26*a*. By this, the nipping member 66 enters the feeding path 79, to nip remaining paper 99 (FIG. 16). In this state, the tray 26 is drawn. By this, the remaining paper 99 can be taken out to the outside of the main assembly. When the user releases the lever 65, the nipping member 66 is stored in the tray 26, and the remaining paper 99 is released.

When remaining paper 99 stops on the transportation belt 78, the tray 26 is dismounted from the main assembly. By this, remaining paper 99 can be removed through the opening 200.

As above when the sheet 14 remains at a rear side of the main assembly A, remaining paper can be easily removed from the front of the main to by and by drawing the tray 26 frontwardly of the main assembly. The sheet having the formed image is discharged toward the front part of the main assembly, and therefore, it removed easily.

Also in this embodiment, the effects similar to the embodiments described above can be provided.

Fifth Embodiment

Figure 18:
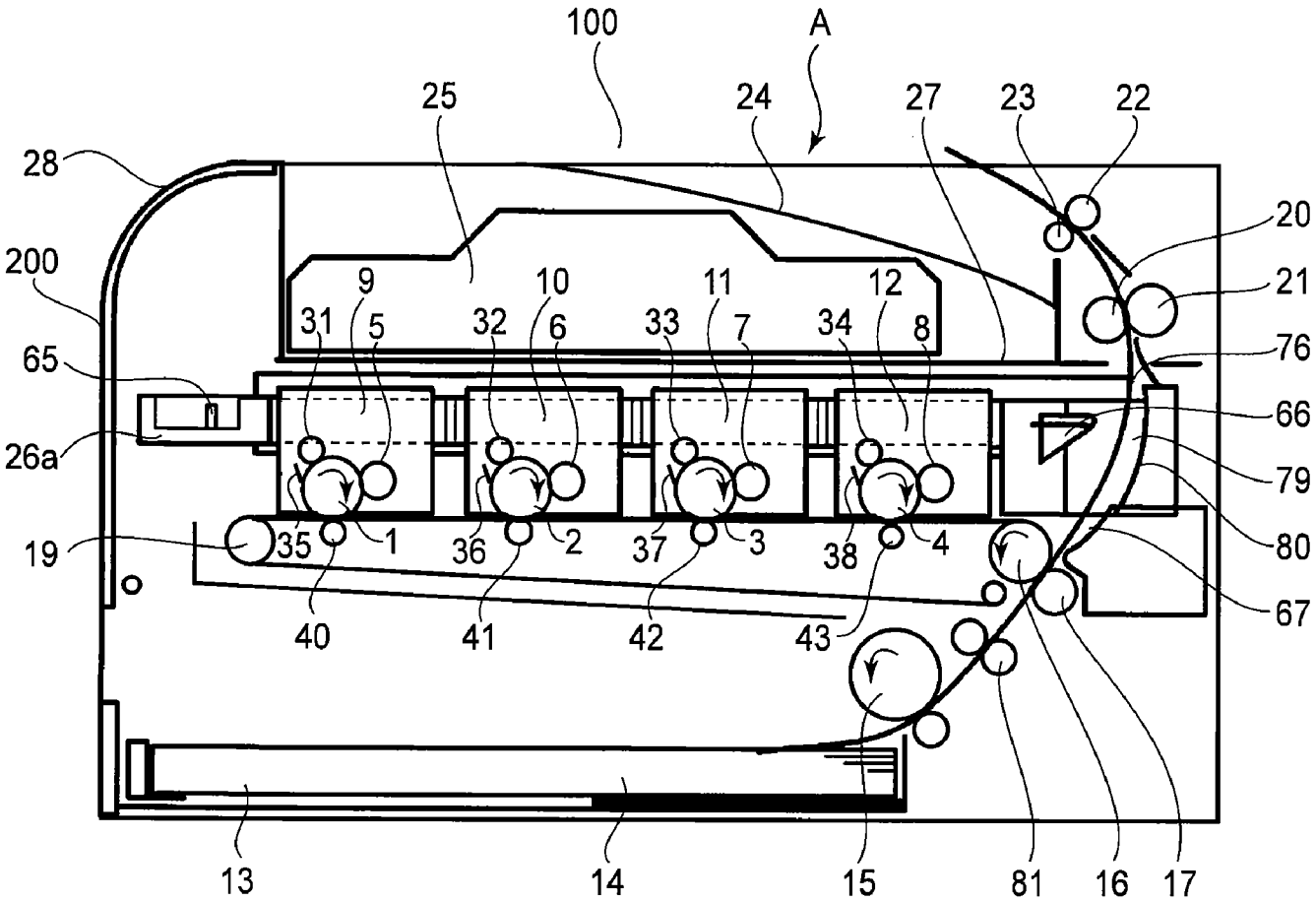
FIG. 18 is a sectional view illustrating the image forming apparatus according to a fifth embodiment.

Referring to FIG. 18, an image forming apparatus according to the fifth embodiment will be described. FIG. 18 is a sectional view illustrating the image forming apparatus according to the fifth embodiment. The like reference numerals as in the foregoing embodiments are assigned to the elements having the corresponding functions The portions peculiar to the present embodiment will be described.

In the first embodiment described above, the feeding roller 15, the transfer roller 17, and the fixing film 20 and so on are provided in the front part of the main assembly. As shown in FIG. 18, the feeding roller 15, the transfer roller 17, and the fixing roller 20 and so on are provided in the rear part of the main assembly in the image forming apparatus according to the present embodiment. The sheet with which the image was formed is discharged toward the front part of the main assembly from the rear part of the main assembly. Accordingly, the user can remove the sheet having the formed image easily.

The tray 26 of the present embodiment is the same as the tray of the fourth embodiment. More particularly the tray 26 is mounted to a position (mount position) I inside of the feeding path 76 which guides the sheet 14, in the main assembly, and is supported by main assembly A (guide 27) to move to the outside position (mounting and dismounting position) O from the inside position I across the feeding path 76.

Furthermore, the tray 26 is provided with the feeding guide portion (guiding member) 80 which constitutes a part of feeding path 76 integrally. The feeding guide portion 80 is provided in the upstream side with respect to the movement direction (drawing direction) of the tray 26 to the outside position from the inside position I. Furthermore, the feeding guide portion 80 is provided with the nipping member (nipping means) 66 for nipping the sheet 14 on the feeding path 79 provided in the feeding guide portion 80. The nipping member 66 is operated by the lever 65 provided on the grip portion 26*a* of the tray 26.

Similarly to the fourth embodiment, accordingly, in the case where remaining paper is in the main assembly, the user opens the door 28 and pulls out a cartridge tray 26. By this, remaining paper 99 can be removed. When remaining paper 99 stops at the front side with respect to a feeding direction of the nipping member 66, remaining paper 99 can be removed by pulling out the feeding tray 13.

In this manner, the present embodiment can also provide the effect similar to the embodiment described above.

Other Embodiment

In the embodiment described above, although the four process cartridges are used, the number is not restrictive and is properly selected by the person skilled in the art, as needed.

The process cartridge detachably mountable relative to the image formation main assembly includes the electrophotographic photosensitive member and any one of the charging means, the developing means, the cleaning means as the process means which is actable on the photosensitive member integrally. The process cartridge has been described as an example of the cartridge, but, the present invention is not limited to this. As the cartridge, the structures described above are included.

In the embodiments described above, the mounting and dismounting operation of the cartridge relative to the cartridge tray and the removing operation of the recording material which remained to the feeding path can be carried out in the same side of the main assembly. Accordingly, the operativity can be improved. The operativity of the operation of picking out the sheet jammed in the feeding path from the main assembly can be improved. In spite of using the tray, the jammed sheet in the feeding path can be easily taken out of the main assembly. In the side in which the tray is drawn to the outside of the main assembly side, the jammed sheet in the feeding path can be taken out of the main assembly. In the side in which an exchanging operation of the cartridge is carried out side, the jammed sheet in the feeding path can be taken out of the main assembly.

While the invention has been described with reference to the structures disclosed herein, it is not confined to the details set forth, and this application is intended to cover such modification or changes as may come within the purposes of the improvements or the scope of the following claims.

This application claims priority from Japanese Patent Applications Nos. 249591/2008 and 218550/2009 filed Sep. 29, 2008 and Sep. 24, 2009, respectively which are hereby incorporated by reference.

What is claimed is:

1. A color electrophotographic image forming apparatus for forming an image on a recording material, wherein a plurality of cartridges is detachably mountable to a main assembly of the apparatus, comprising:

a cartridge supporting member for supporting said cartridges, said cartridge supporting member being movable between an inside position which is inside said main assembly of the apparatus and an outside position which is outside said main assembly of the apparatus, wherein said cartridges are mounted to and dismounted from said cartridge supporting member when said cartridge supporting member is at the outside position;

an opening which is provided in said main assembly of the apparatus and through which said cartridge supporting member passes when said cartridge supporting member moves between the inside position and the outside position;

a feeding path which is provided in said cartridge supporting member and along which the recording material fed from a stacking portion for stacking the recording material passes; and nipping means for nipping a jammed recording material stopped in said feeding path, said nipping means being disposed in an upstream side with respect to a drawing direction in which said cartridge supporting member is moved from the inside position to the outside position, wherein when said cartridge supporting member is moved in the drawing direction which crosses with said feeding path, the jammed recording material is pulled toward said opening in the state that said nipping means nips the jammed recording material.

2. An apparatus according to claim 1, wherein said nipping means nips the jammed recording material by projecting into said feeding path.

3. An apparatus according to claim 2, wherein said cartridge supporting member includes a gripping portion for operating when said cartridge supporting member is moved, and said gripping portion is provided with a lever for causing said nipping means to project into said feeding path in interrelation with said nipping means.

4. An apparatus according to claim 3, wherein said gripping portion is disposed in an downstream side with respect to the drawing direction.

5. An apparatus according to claim 1, further comprising a transfer device including an intermediary transfer belt onto which the developed image is transferred from each of a electrophotographic photosensitive members provided on said cartridge supporting member when said cartridge supporting member is at the inside position, wherein said feeding path is disposed between said transfer device and a fixing member for fixing the developed images transferred onto the recording material on the recording material with respect to a feeding direction of the recording material.

6. An apparatus according to claim 1, further comprising a transfer device including a feeding belt for carrying and feeding the recording material, and the developed image is transferred onto the recording material carried on said feeding belt from each of a electrophotographic photosensitive members provided on said cartridge supporting member when said cartridge supporting member is at the inside position, wherein said feeding path is disposed between said transfer device and a fixing member for fixing the developed images transferred onto the recording material on the recording material with respect to a feeding direction of the recording material.

* * * * *